US010427842B2

(12) United States Patent
Siskindovich et al.

(10) Patent No.: US 10,427,842 B2
(45) **Date of Patent: *Oct. 1, 2019**

(54) TAMPER-EVIDENT CONTAINERS

(71) Applicant: Sabert Corporation, Sayreville, NJ (US)

(72) Inventors: Yohanan Siskindovich, Glen Ridge, NJ (US); Darryl Nazareth, Flanders, NJ (US); Radhikan Kusam, Parlin, NJ (US); Stephen Ricci, Voorhees, NJ (US); Sameh Guirguis, Monrie, CT (US); Bernard Ampomah, Williamstown, NJ (US)

(73) Assignee: SABERT CORPORATION, Sayreville, NJ (US)

( * ) Notice: Subject to any disclaimer, the term of this patent is extended or adjusted under 35 U.S.C. 154(b) by 33 days.

This patent is subject to a terminal disclaimer.

(21) Appl. No.: 15/483,461

(22) Filed: Apr. 10, 2017

(65) Prior Publication Data

US 2017/0210514 A1 Jul. 27, 2017

Related U.S. Application Data

(62) Division of application No. 14/771,755, filed as application No. PCT/US2014/027533 on Mar. 14, 2014, now Pat. No. 9,745,106.

(Continued)

(51) Int. Cl.

| | |
|---|---|
| ***B65D 43/02*** | (2006.01) |
| ***B65D 43/16*** | (2006.01) |
| ***B65D 1/34*** | (2006.01) |

(52) U.S. Cl.

CPC ..... *B65D 43/0254* (2013.01); *B65D 1/34* (2013.01); *B65D 43/0249* (2013.01);

(Continued)

(58) Field of Classification Search

CPC .. B65D 2101/0023; B65D 2543/00101; B65D 43/0235; B65D 17/161;

(Continued)

(56) References Cited

U.S. PATENT DOCUMENTS 3,338,446 A 8/1967 Faulstich
3,773,207 A * 11/1973 Dokoupil ..... B65D 43/0254 220/266

(Continued)

FOREIGN PATENT DOCUMENTS

CN 201530511 7/2010
EP 0200392 A2 11/1986

(Continued)

OTHER PUBLICATIONS

Office Action dated Apr. 25, 2018 issued in U.S. Appl. No. 14/174,325, 12 pages.

(Continued)

*Primary Examiner* — Shawn M Braden
(74) *Attorney, Agent, or Firm* — Cozen O'Connor

(57) ABSTRACT

A tamper-evident container formed by thermoforming includes a tub having a bottom and a sidewall forming an interior volume. The container has a lid with an edge extending peripherally outward therefrom which is configured to mate with the tub edge to close the container. The lid edge has an inner portion and an outer portion with a perforated section therebetween. The perforated section extends continuously around the entire periphery of the lid, whereby the outer portion forms a tamper-evident seal removable from the inner portion for removing the lid from the tub. Texture elements are distributed around the outer portion of the lid edge which are configured to provide a visual indication of the presence of the tamper-evident seal. The tub edge is disposed beneath the outer portion of the lid (Continued)

edge and extends peripherally outward so that a substantial part of the outer portion of the lid edge does not extend below the tub edge in a vertical direction of the container in an upright orientation. A tab extends from the outer portion of the lid edge and below the tub edge in the vertical direction of the container.

27 Claims, 21 Drawing Sheets

Related U.S. Application Data

(60) Provisional application No. 61/793,919, filed on Mar. 15, 2013.

(52) U.S. Cl.
CPC .... *B65D 43/162* (2013.01); *B65D 2101/0023* (2013.01); *B65D 2543/005* (2013.01); *B65D 2543/0062* (2013.01); *B65D 2543/00101* (2013.01); *B65D 2543/00222* (2013.01); *B65D 2543/00296* (2013.01); *B65D 2543/00351* (2013.01); *B65D 2543/00361* (2013.01); *B65D 2543/00537* (2013.01); *B65D 2543/00555* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 2101/003; B65D 2101/0053; B65D 2543/00296
See application file for complete search history.

(56) References Cited

U.S. PATENT DOCUMENTS

| | | | | |
|---|---|---|---|---|
| 3,937,389 | A * | 2/1976 | Wind | B65D 1/34 229/406 |
| 4,006,839 | A | 2/1977 | Thiel et al. | |
| 4,091,930 | A | 5/1978 | Buchner | |
| 4,103,803 | A | 8/1978 | Irvine | |
| 4,113,136 | A | 9/1978 | Abbott | |
| 4,315,791 | A | 2/1982 | Ishii et al. | |
| 4,474,304 | A | 10/1984 | Jacobs | |
| 4,487,329 | A | 12/1984 | Winstead | |
| 4,535,889 | A | 8/1985 | Terauds | |
| 4,560,082 | A | 12/1985 | Sutch | |
| 4,721,210 | A | 1/1988 | Lawrence | |
| 4,738,375 | A | 4/1988 | Rosen et al. | |
| 4,798,301 | A | 1/1989 | Bullock et al. | |
| 4,930,656 | A | 6/1990 | Blanchette | |
| 4,961,512 | A | 10/1990 | Von Holdt | |
| 5,377,860 | A | 1/1995 | Littlejohn et al. | |
| 5,511,680 | A | 4/1996 | Kinne | |
| 6,170,696 | B1 | 1/2001 | Tucker et al. | |
| 6,279,774 | B1 | 8/2001 | Clute et al. | |
| 6,499,621 | B1 | 12/2002 | Yamaguchi et al. | |
| 6,604,645 | B1 | 8/2003 | Vaupotic | |
| 6,779,676 | B2 | 8/2004 | Ciccone | |
| 6,899,245 | B1 | 5/2005 | Nelson | |
| D637,489 | S | 5/2011 | Petlak et al. | |
| D638,704 | S | 5/2011 | Petlak et al. | |
| 8,083,089 | B2 | 12/2011 | Vovan | |
| 8,127,961 | B2 | 3/2012 | Vovan | |
| 8,251,242 | B2 | 8/2012 | Vovan | |
| 8,672,166 | B2 * | 3/2014 | Nazareth | B65D 43/0241 215/256 |
| 8,795,580 | B2 | 8/2014 | Sellari | |
| 8,851,315 | B2 | 10/2014 | Vovan | |
| 2004/0094553 | A1 | 5/2004 | Crider et al. | |
| 2005/0133508 | A1 | 6/2005 | Landis et al. | |
| 2005/0189353 | A1 | 9/2005 | Padovani | |
| 2006/0006178 | A1 | 1/2006 | Foldesi, Sr. et al. | |
| 2006/0175334 | A1 | 8/2006 | Schwarz | |
| 2006/0266750 | A1 | 11/2006 | Lesquir | |
| 2006/0278652 | A1 | 12/2006 | Vovan et al. | |
| 2007/0012710 | A1 | 1/2007 | Vovan et al. | |
| 2007/0045317 | A1 | 3/2007 | Rosender et al. | |
| 2008/0035641 | A1 | 2/2008 | Foldesi et al. | |
| 2008/0274313 | A1 | 11/2008 | Hanten | |
| 2008/0302798 | A1 * | 12/2008 | Foldesi, Sr. | B65B 7/2878 220/276 |
| 2010/0065567 | A1 | 3/2010 | Vovan | |
| 2010/0084400 | A1 | 4/2010 | Juliani | |
| 2010/0155289 | A1 | 6/2010 | Nazareth et al. | |
| 2012/0048774 | A1 | 3/2012 | Gingras et al. | |

FOREIGN PATENT DOCUMENTS

| | | |
|---|---|---|
| JP | 10-120004 | 5/1998 |
| WO | WO 2005/056414 | 6/2005 |
| WO | WO 2008/021262 | 2/2008 |

OTHER PUBLICATIONS

Office Action dated Aug. 15, 2016 which issued in the corresponding Chinese Patent Application No. 201480026682.1.
Office Action dated Apr. 21, 2017 which issued in the corresponding Chinese Patent Application No. 201480026682.1.
Office Action dated Oct. 27, 2017 which issued in the corresponding Chinese Patent Application No. 201480026682.1, 27 pages.
Office Action dated Nov. 20, 2017 which issued in U.S. Appl. No. 14/174,325 12 pages.
DE 46—Pactiv Motion for Reconsideration re Court's Aug. 20, 2015 Order, dated Dec. 14, 2015, *Sabert Corp.* v. *PWP Ind., Inc.*, Civil Action No. 3:14-cv-06500-MAS-DEA (D. N.J., filed Oct. 21, 2014), 72 pages.
DE 29—Defendants Reply re Motion to Dismiss and Opp. to Sabert Cross-Motion, dated Feb. 20, 2015, *Sabert Corp.* v. *PWP Ind., Inc.*, Civil Action No. 3:14-cv-06500-MAS-DEA (D. N.J., filed Oct. 21, 2014), 59 pages.
DE 30—Sabert Reply re Cross-Motion to Amend 1st Amended Complaint, dated Mar. 2, 2015, *Sabert Corp.* v. *PWP Ind., Inc.*, Civil Action No. 3:14-cv-06500-MAS-DEA (D. N.J., filed Oct. 21, 2014), 281 pages.
Sabert Responses to Pactiv 1st Set of Interrogatories, dated Dec. 2, 2015, *Sabert Corp.* v. *PWP Ind., Inc.*, Civil Action No. 3:14-cv-06500-MAS-DEA (D. N.J., filed Oct. 21, 2014), 19 pages.
Sabert Responses to Pactiv 1st Set of Requests for Admission, dated Dec. 2, 2015, *Sabert Corp.* v. *PWP Ind., Inc.*, Civil Action No. 3:14-cv-06500-MAS-DEA (D. N.J., filed Oct. 21, 2014), 10 pages.
Sabert ltr to Judge Arpert—response to Pactiv ltr re discovery dispute re subpoenas, dated Dec. 23, 2015, *Sabert Corp.* v. *PWP Ind., Inc.*, Civil Action No. 3:14-cv-06500-MAS-DEA (D. N.J., filed Oct. 21, 2014), 31 pages.
Pactiv Invalidity and Non-Infringement Contentions, dated Jan. 19, 2016, *Sabert Corp.* v. *PWP Ind., Inc.*, Civil Action No. 3:14-cv-06500-MAS-DEA (D. N.J., filed Oct. 21, 2014), 90 pages.

* cited by examiner

TAMPER-EVIDENT CONTAINERS

CROSS-REFERENCE TO RELATED APPLICATION

This application is a divisional of U.S. patent application Ser. No. 14/771,755 which was filed with the U.S. Patent and Trademark Office on Aug. 31, 2015. U.S. patent application Ser. No. 14/771,755 is a U.S. national stage of application No. PCT/US2014/027533, filed on 14 Mar. 2014, which claims the benefit of U.S. Provisional Patent Application No. 61/793,919, filed on 15 Mar. 2013, both of which are hereby incorporated by reference in their entireties.

FIELD OF THE INVENTION

The disclosed embodiments relate to resealable containers with tamper-evident features for storing and displaying food and various other items.

BACKGROUND OF THE INVENTION

The use of plastic disposable containers and trays for packaging, distributing, food is widespread in the marketplace. For example, the drug and pharmaceutical industries use tamper-evident and tamper-resistant medicine containers to mitigate and minimize risks of intentional or unintentional tampering. Similarly, the food industry is demanding that food containers also incorporate tamper-evident and tamper-resistant features.

These tamper-evident features typically include structural design elements which, when the container is tampered with or opened, enable the consumer to easily visually recognize such tampering so that the product can be rejected.

Besides ensuring product safety, such tamper-evident and resistant elements are important for, among other things, deterring theft and preventing the loss of product and income for the seller, as well as inspiring consumer confidence in the integrity of the contents within the container, and confidence in the ability of the seller and/or manufacturer to provide and maintain quality goods and food products.

SUMMARY OF THE INVENTION

The disclosed embodiments provide tamper-evident, resealable containers, e.g., for food products. The disclosed embodiments include such features as: tear-away strips with one or more break points to prevent formation of a closed loop when the strip is removed, texturized treatment of the surface of the tear-away strip to increase the visibility of the strip, and a vertical, or nearly vertical, removal tab which is more easily visible from the side of the container.

Various different configurations of break points are possible, including one break point to form a single continuous strip or at least two break points to form at least two separate pieces of strip. In certain embodiments, the break points may be configured so that they do not break immediately upon removal of the tear-away strip, thereby allowing a closed loop to be formed by the tear-away strip. However, in such a configuration, the break points are configured to break when a predetermined force is applied to the closed loop as a safety feature, e.g., if the loop is being pulled over a child's head. Thus, the use of break points allows for various configurations of tear-away strip removal, e.g., closed loop, one continuous strip, multiple strip pieces (e.g., two separate strip pieces), etc.

The disclosed embodiments also provide various shapes of the lid and tray rims which form locking mechanisms to keep the lid attached to the bottom portion of the container. The disclosed embodiments also provide a tamper-evident container having a hinge and a tear-away strip that extends around three of the four sides of the container. In certain embodiments, the tear-away strip may also extend onto a portion of the fourth side of the container.

In one aspect, the present invention provides a tamper-evident container formed by thermoforming which includes a tub having a bottom and a sidewall forming an interior volume, the tub further comprising an edge extending peripherally outward from an upper edge of the sidewall. The container further includes a lid having an edge extending peripherally outward therefrom, the lid edge being configured to mate with the tub edge to close the container. The lid edge has an inner portion and an outer portion which have a perforated section therebetween. The perforated section extends continuously around the entire periphery of the lid, whereby the outer portion forms a tamper-evident seal removable from the inner portion for removing the lid from the tub. The container further includes texture elements distributed around the outer portion of the lid edge, the texture elements being configured to provide a visual indication of the presence of the tamper-evident seal. The tub edge is disposed beneath the outer portion of the lid edge and extends peripherally outward so that a substantial part of the outer portion of the lid edge does not extend below the tub edge in a vertical direction of the container in an upright orientation. A tab extends from the outer portion of the lid edge and beyond the tub edge, the tab extending below the tub edge in the vertical direction of the container.

Embodiments of the present invention may include one or more of the following features. A first force applied to the outer portion of the lid edge sufficient to cause the perforated section to separate may be less than a second force sufficient to overcome an interference fit lock between the inner portion of the lid edge and the tub edge to remove the lid from the tub. After the outer portion of the lid edge is removed, the inner portion of the lid edge may be configured for an interference fit with the tub edge for removably securing the lid to the tub. The inner portion of the lid edge may include an inner tab having an edge that is exposed when the tamper-evident seal is removed. The texture elements may have ridges extending in the vertical direction of the container.

The container may be formed of any of the following plastic materials: high density polyethylene (HDPE), polyethylene terephthalate (PET), polypropylene (PP), polystyrene (PS), and polylactic acid (PLA).

The outer portion of the lid edge, except for the tab, may be in contact with the tub edge around the entire periphery of the tub. The tab may be the only portion of the lid extending below the tub edge. The tub edge and the lid edge may each have a corresponding peripheral channel configured so that one of the peripheral channels is received in the other of the peripheral channels for securing the lid to the tub. Each of the peripheral channels may include an inner wall and an outer wall joined by a horizontal channel wall. The inner wall of the peripheral channel of the tub edge may have a protrusion which mates with a corresponding protrusion in the inner wall of the peripheral channel of the lid edge to create an interference fit between the peripheral channels when the lid is secured to the tub. The perforated section of the lid edge may be formed in the horizontal channel wall of the lid edge. The outer portion of the lid edge may include a bridge portion formed by a gap in the outer wall of the peripheral channel and having a perforated segment on the horizontal channel wall of the peripheral channel, the perforated segment extending outward from the perforated section to divide the tamper-evident strip. The outer portion of the lid edge may include at least two bridge portions so as to divide the tamper-evident strip into at least two separate pieces.

In another aspect, the present invention provides a tamper-evident container formed by thermoforming, including a tub having a bottom and a sidewall forming an interior volume, the tub further comprising an edge extending peripherally outward from an upper edge of the sidewall. The container further includes a lid having an edge extending peripherally outward therefrom, the lid edge being configured to mate with the tub edge to close the container. The lid edge has an inner portion and an outer portion which have a perforated section therebetween. The perforated section extends continuously around the entire periphery of the lid, whereby the outer portion forms a tamper-evident seal removable from the inner portion for removing the lid from the tub. The container further includes texture elements distributed around the outer portion of the lid edge, the texture elements being configured to provide a visual indication of the presence of the tamper-evident seal. Before the outer portion of the lid edge is removed, the lid edge is matable with the tub edge to secure the lid to the tub without applying heat or adhesive.

Embodiments of the present invention may include one or more of the following features. A tab may extends from the outer portion of the lid edge and beyond the tub edge, the tab extending below the tub edge in a vertical direction of the container in an upright orientation. The tab may be the only portion of the lid extending below the tub edge. The tub edge and the lid edge may each have a corresponding peripheral channel configured so that one of the peripheral channels is received in the other of the peripheral channels for securing the lid to the tub. Each of the peripheral channels may include an inner wall and an outer wall joined by a horizontal channel wall. The inner wall of the peripheral channel of the tub edge may have a protrusion which mates with a corresponding protrusion in the inner wall of the peripheral channel of the lid edge to create an interference fit between the peripheral channels when the lid is secured to the tub. The perforated section of the lid edge may be formed in the horizontal channel wall of the lid edge.

The outer portion of the lid edge may include a bridge portion formed by a gap in the outer wall of the peripheral channel and having a perforated segment on the horizontal channel wall of the peripheral channel, the perforated segment extending outward from the perforated section to divide the tamper-evident strip. The outer portion of the lid edge may include at least two bridge portions so as to divide the tamper-evident strip into at least two separate pieces.

The lid and the tub may be formed as a single unit so that the tray edge and the outer portion of the lid edge are joined along a side of the container, with a hinge being formed between the tray and lid to allow the lid to be folded onto the tray to close the container. The tub may have a wedge-like polyhedral shape with two trapezoidal opposing sides which narrow toward the bottom of the tub.

In another aspect, the present invention provides a tamper-evident container formed by thermoforming, including a base tray having a bottom and a sidewall forming an interior volume, the tray further comprising an edge extending peripherally outward from an upper edge of the sidewall. The container further includes a lid having an edge extending peripherally outward therefrom, the lid edge being configured to mate with the tray edge to close the container. The lid edge has an inner portion and an outer portion which have a perforated section therebetween. The perforated section extends continuously around the entire periphery of the lid, whereby the outer portion forms a tamper-evident seal removable from the inner portion for removing the lid from the tray. The tray edge is disposed beneath the outer portion of the lid edge and extends peripherally outward so that a substantial part of the outer portion of the lid edge does not extend below the tray edge. The perforated section of the lid edge is formed in a horizontal wall of a peripheral channel extending around the lid edge. The outer portion of the lid edge comprises a bridge portion having a perforated segment which extends outward from the perforated section to divide the tamper-evident strip.

Embodiments of the present invention may include one or more of the following features. A tab may extend from the outer portion of the lid edge and beyond the tray edge.

The inner wall of the peripheral channel of the tray edge may have a first protrusion which mates with a corresponding first protrusion in the inner wall of the peripheral channel of the lid edge to create an interference fit between the peripheral channels when the lid is secured to the tray, and the inner wall of the peripheral channel of the tray edge may have a second protrusion which mates with a corresponding second protrusion in the inner wall of the peripheral channel of the lid edge to create an interference fit between the peripheral channels when the lid is secured to the tray. The first and second protrusions may be oriented in opposite directions.

There may be a third, downward facing protrusion formed in the tray edge between the inner wall of the peripheral channel of the tray edge and a point where the tray edge meets the sidewall of the tray, the third protrusion being configured to mate with a corresponding third protrusion in the lid edge. An interference fit between the first, second, and third protrusions of the tray edge and the corresponding first, second, and third protrusions of the lid edge may provide resistance to liquid escaping from the container between the tray edge and lid edge.

A first set of corresponding sealing surfaces may be provided by the second protrusions of the lid edge and the tray edge, a second set of sealing surfaces may be provided by the third protrusions of the lid edge and the tray edge, and a third set of sealing surfaces may be provided on the diagonally-sloping portion between the third protrusions of the lid edge and the tray edge and a point at which the lid edge and the tray edge separate at the interior volume of the container. These three sets of sealing surfaces may form a three-stage leak-resistant seal between the lid edge and the tray edge.

BRIEF DESCRIPTION OF THE DRAWINGS

The above and/or other aspects and advantages will become more apparent and more readily appreciated from the following detailed description of the disclosed embodiments taken in conjunction with the accompanying drawings of which.

DETAILED DESCRIPTION

FIGS. 1-6 show an embodiment of a tamper-evident container 100 including a tub 110 and a flat lid 120. Containers of this type may be used, for example, to store and display various food products, such as nuts, dried fruit, cut fruit, etc., on a grocery store shelf or display unit. The tamper-evident containers disclosed herein may be produced using a thermoforming process and may be formed of any of a number of materials which are amendable to this process, such as, for example, high density polyethylene (HDPE), polyethylene terephthalate (PET), polypropylene (PP), polystyrene (PS), and polylactic acid (PLA).

The basic thermoforming process involves feeding a heated thermoplastic film to a metal mold, which then uses a vacuum force applied through small holes in the mold (and possibly pressurized air) to cause the material to conform to the shape of the mold. Once the material cools, it is then removed from the mold and trimmed to form the completed thermoformed part.

Figure 1:
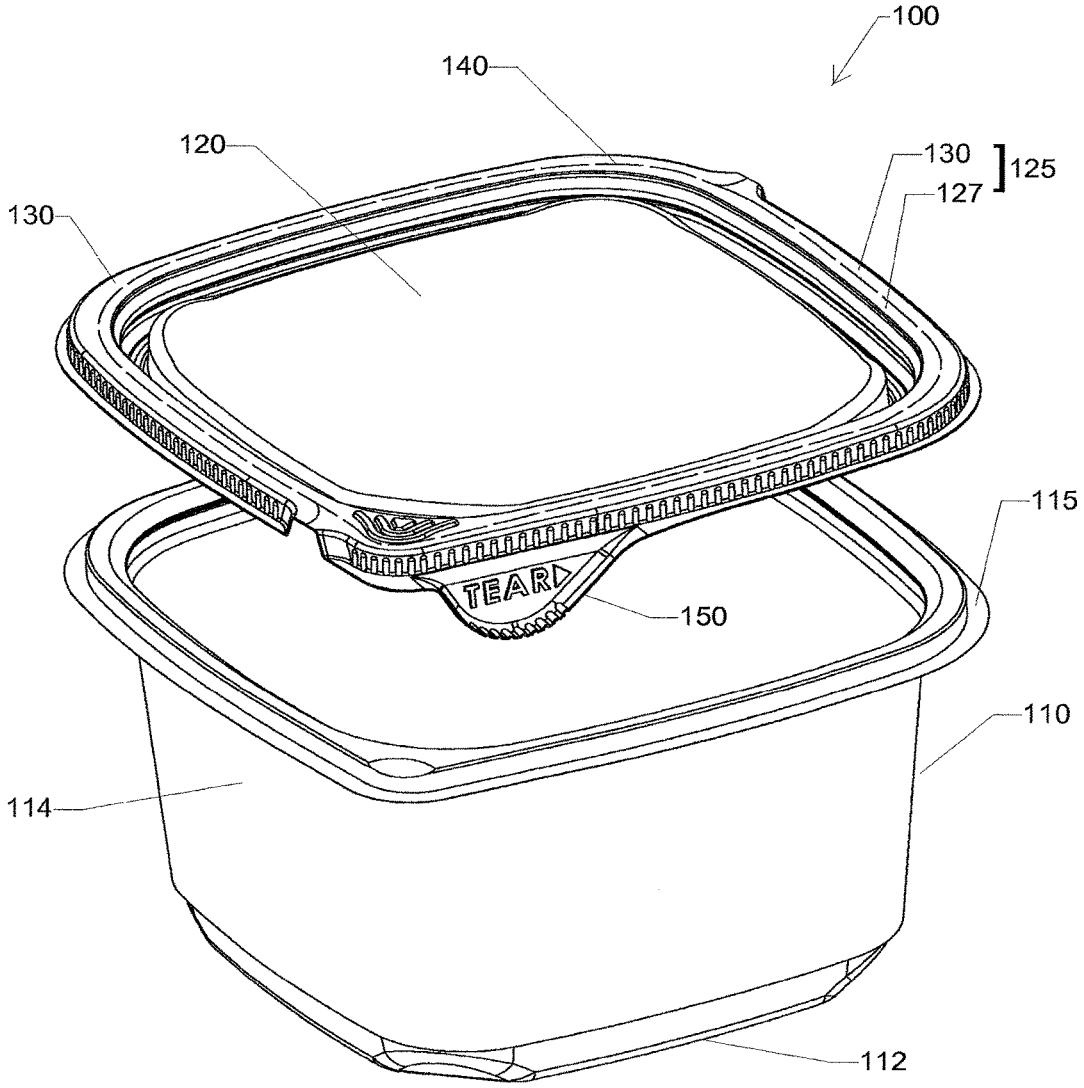
FIG. 1 shows an embodiment of a tamper-evident container including a tub and a flat lid, depicted prior to the lid being secured to the tub, the lid having a tear-away strip which is texturized and includes break points and a downwardly-extending tab.
Figure 2:
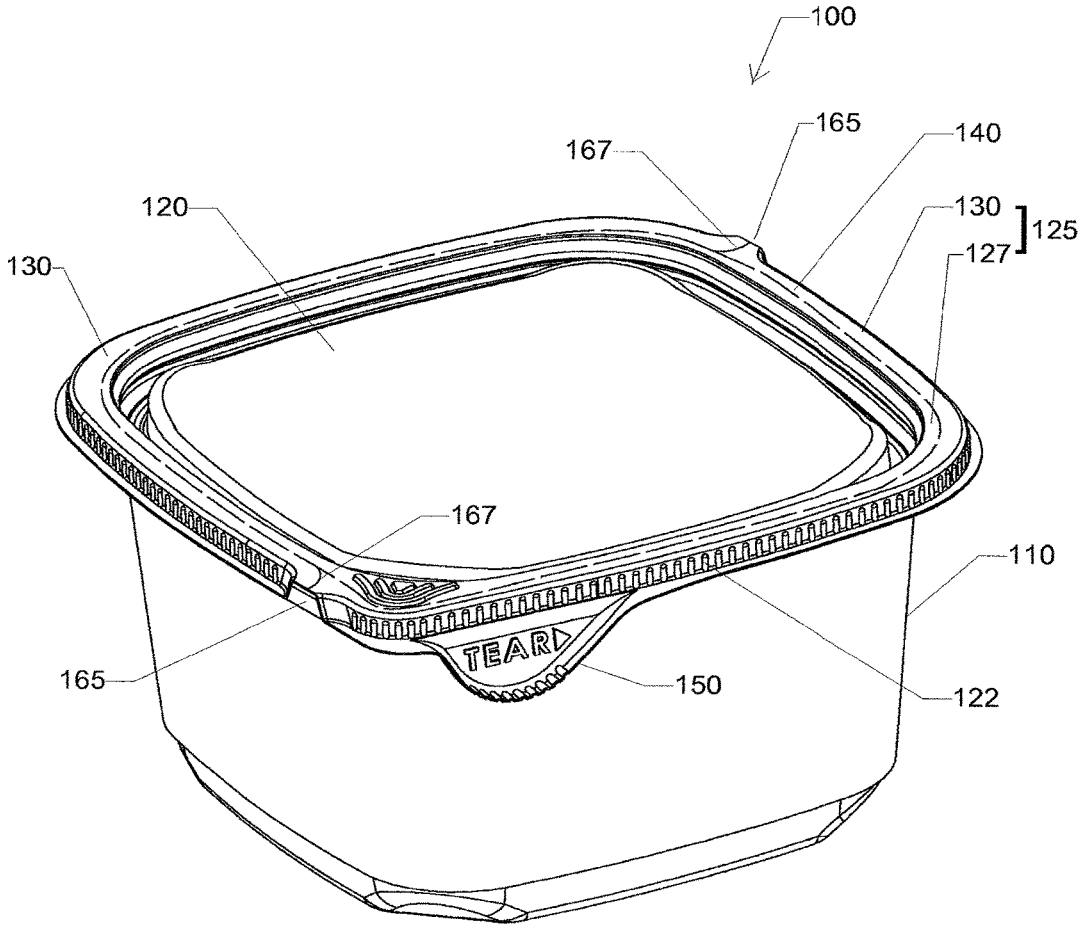
FIG. 2 shows the tamper-evident container of FIG. 1 after the lid is secured to the tub.

FIG. 1, in particular, shows the container 100 prior to the lid 120 being secured to the tub, and FIG. 2 shows the tamper-evident container 100 after the lid 120 is secured to the tub 110. In the embodiment depicted, the tub 110 is substantially square in shape and has a bottom face 112 and a sidewall 114, e.g., a sidewall 114 having four sides, which together define an interior volume of the container 100. Other shapes may also be used, such as, for example, a rectangular tub or a round tub. The tub 110 has an upper edge, referred to herein as the "tub edge" 115, which extends peripherally outward from the upper edge of the sidewall 114, as will be described in further detail below.

In this embodiment, the lid 120 has a substantially flat surface in the central portion thereof. Other shapes may also be used, such as, for example, a domed or rounded shape or a plateau-like shape having a raised flat surface with angled sides. Like the tub 110, the lid 120 has an edge 125 which extends peripherally outward from the mostly flat central portion. The lid edge 125 is shaped to mate with the tub edge 115 to secure the container 100.

The lid edge 125 has an inner peripheral portion 127 and an outer peripheral portion 130 (relative to a center of the container 100) having a perforated section 140 in between, which may be formed, for example, in a stamping process in which a die contacts the thermoformed material to partially cut through the material. Alternatively, the perforated section 140 may be formed by other techniques, such as, for example, laser perforating. The perforated section 140 extends continuously around the entire periphery of the lid 120. In this way, the outer portion 130 of the lid edge 125 forms a tamper-evident seal, in the form of a tear-away strip, which when removed, or partially separated, from the inner portion 127 allows the lid 120 to be removed from the tub 110. In one advantageous aspect, before the outer portion 130 of the lid edge 125 is removed, the lid edge 125 can be coupled with the tub edge 115 to secure the lid 120 to the tub 110 without applying heat or adhesive.

FIG. 2 shows the tub 110 with a lid 120 in place before any of the tear-away strip (i.e., the outer portion 130 of the lid edge 125) has been removed. The end user, e.g., a consumer, accesses a removal tab 150 which extends from the lid 120 near a corner.

Figure 3:
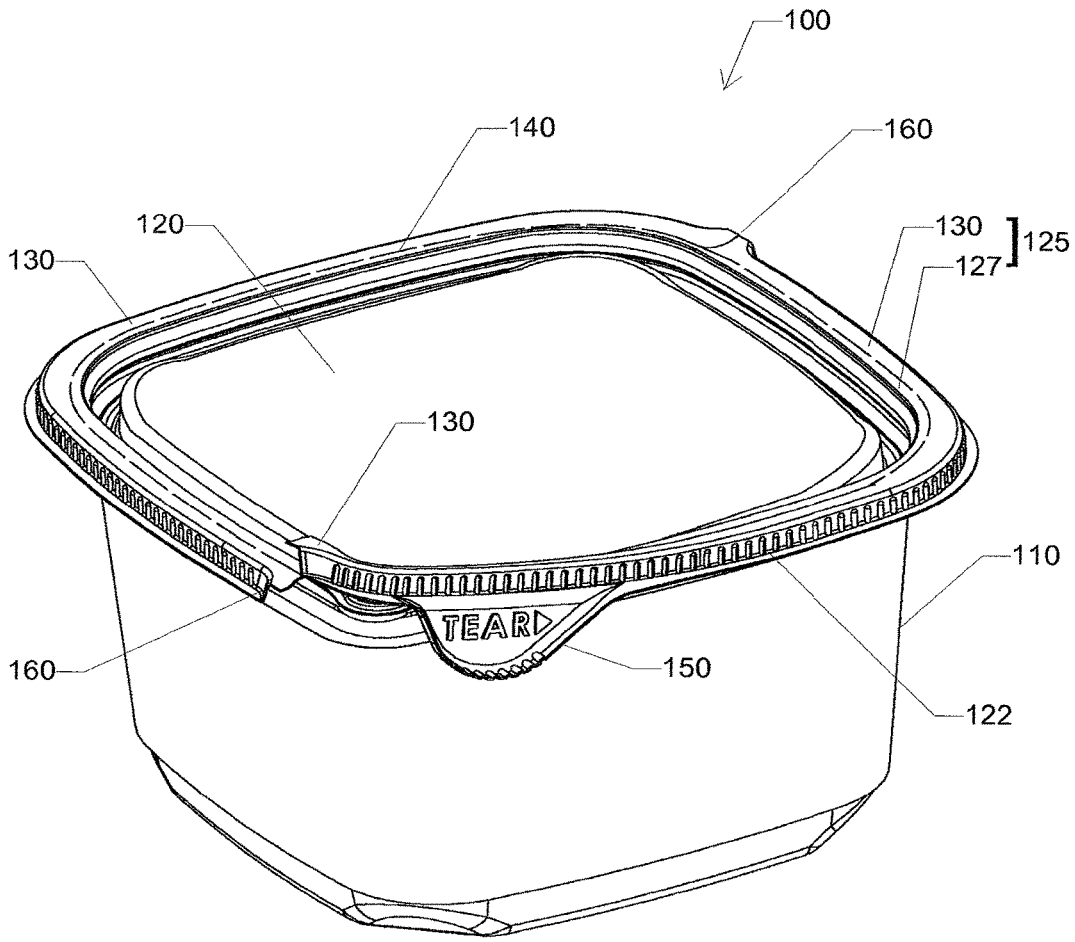
FIG. 3 shows the tamper-evident container of FIG. 1 during the initial stage of removing the tear-away strip by pulling on the tab.

FIG. 3 shows the tamper-evident container 100 of this embodiment during the initial stage of removing the tear-away strip 130 by pulling on the removal tab 150. The force applied by the user on the tear-away strip 130 causes the outer portion 130 of the lid edge 125 to separate from the inner portion 127 of the lid edge 125 along the perforated section 140. Also, as explained in further detail below, the tear-away strip 130 itself breaks into separate pieces at defined break points or "bridge portions" 160. The force required to break the perforated section 140 is less than, and preferably substantially less than, the force required to remove the lid 120 from the tub 110. Therefore, the tamper-evident strip 130 can be reliably removed from the container 100 without opening the container 100. This, in turn, means that the container 100 cannot be opened without leaving visible evidence, i.e., without leaving a tamper-evident strip 130 which is at least partially detached from the lid 120.

The tab 150 extends from the outer portion 130 of the lid edge 125 and beyond the tub edge 115. Also, in this embodiment, the tab 150 extends downward from the edge of the lid 120 so that it extends at an angle or is nearly vertical. The tab 150 may extend at an angle of, for example, between about 45 degrees and about 90 degrees relative to horizontal. Alternatively, the tab 150 may extend at an angle of between about 30 degrees and about 60 degrees relative to horizontal.

Among the advantages of this configuration is that it makes the tab 150 easier to identify from the side of the container 100. In other words, the tab 150 is more visible than a conventional, horizontally-oriented tab when the container 100 is viewed from the side. Yet, because the tab 150 may be slightly angled outward from the container 100, it is also visible from above, looking down on the container 100. Thus, the removal tab 150, and the markings on the surface thereof (e.g., an arrow or the words "remove" or "tear"), are clearly visible from both a side and perspective viewing angle, which makes it convenient to see when the container 100 is on a store shelf.

Figure 4:
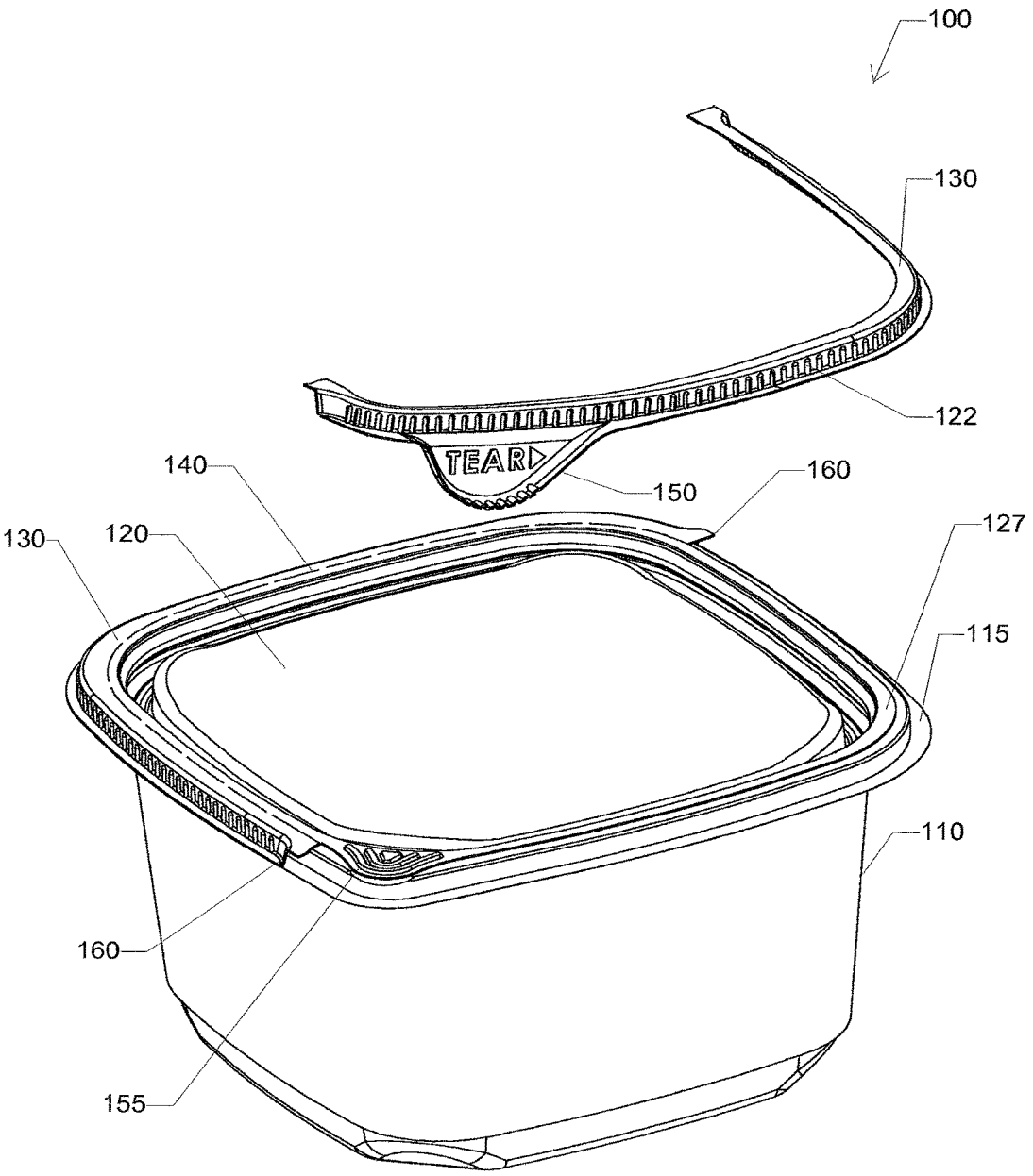
FIG. 4 shows the tamper-evident container of FIG. 1 with a portion of the tear-away strip between two break points completely removed from the lid.

FIG. 4 shows the tamper-evident container 100 with a portion of the tear-away strip 130 between two break points 160 completely removed from the lid 120. The tear-away strip 130 may be configured to break at one or more frangible portions, i.e., bridge portions 160, one of which may be, for example, near the tear tab 150. The bridge portion 160 is part of the outer portion 130 of the lid edge 125 and is formed by a gap 165 (see FIG. 2) in the outer wall 180 of the peripheral channel 170 of the lid edge 125 (see FIG. 6 and related description below) and a perforated segment 167 (see FIG. 2) on the horizontal channel wall 185 of the peripheral channel 170 of the lid edge 125. The perforated segment 167 extends outward from the perforated section 140 and through the bridge portion 160 to allow a sectional removal of the tamper-evident strip 130. In this embodiment, the outer portion 130 of the lid edge 125 includes at least two bridge portions 160, so as to divide the tamper-evident strip 130 into at least two separate pieces.

Therefore, as the tear-away strip 130 separates from the edge of the lid 120 around the perimeter of the lid 120, it takes the form of one or more continuous lengths of material, rather than a closed loop or ring of material. The bridge portions 160, thus, prevent formation of a closed plastic loop or ring, which may pose a choking danger to pets and children, as well as a threat to wildlife and the environment. As shown in FIG. 4, once the tear-away strip 130 has been removed, the inner tab 155 portion of the lid 120 (i.e., "open tab") may be accessed by the customer to allow an easy removal of the lid 120. In certain embodiments, the tear-away strip 130 may have at least two break points 160 so that the removal of one of the at least two divided portions of the tear-away strip 130 may allow the lid 120 to be removed, while the other portion of the tear-away strip 130 remains on the lid 120, as shown in FIG. 4.

As shown, in FIGS. 1-4, texture elements 122 may be distributed around the tamper-evident seal (i.e., tear-away strip 130) which are shaped to provide a visual indication of the presence of the tamper-evident seal. The texture elements 122 may be, e.g., slots, ridges, bumps, indentations, protrusions, etc., which may be oriented in the vertical direction of the container 100 when in the upright position. Other texture elements also may be used, such as, for example, dimples, raised lines, diagonally-oriented raised elements, or horizontal bands or ridges. The texturized tear-away strip 130 is readily apparent when the container 100 is viewed from the side and/or from above (i.e., when the container is viewed from directions giving the viewer a side or perspective view). Thus, the texturized surface of the tear-away strip 130 makes it clear whether the strip is still in place or has been removed, because the rim portion left after the strip is removed clearly lacks the texture elements 122 (see FIG. 4).

Figure 5:
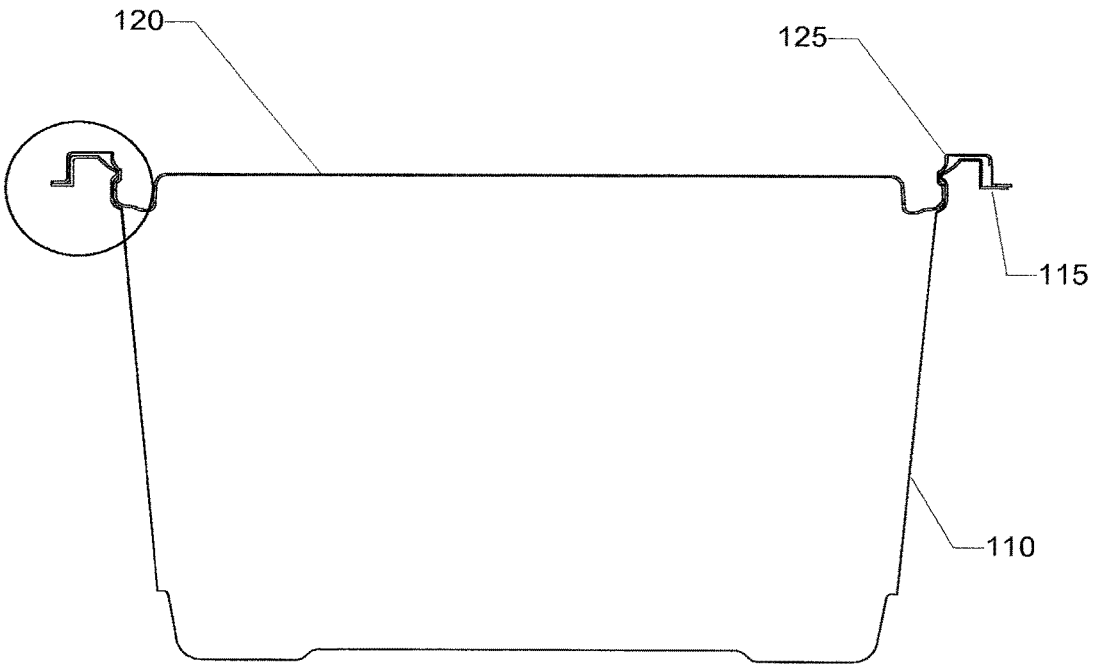
FIG. 5 shows a vertical cross-sectional view of the tamper-evident container of FIG. 1 taken through the middle of the tub.
Figure 6:
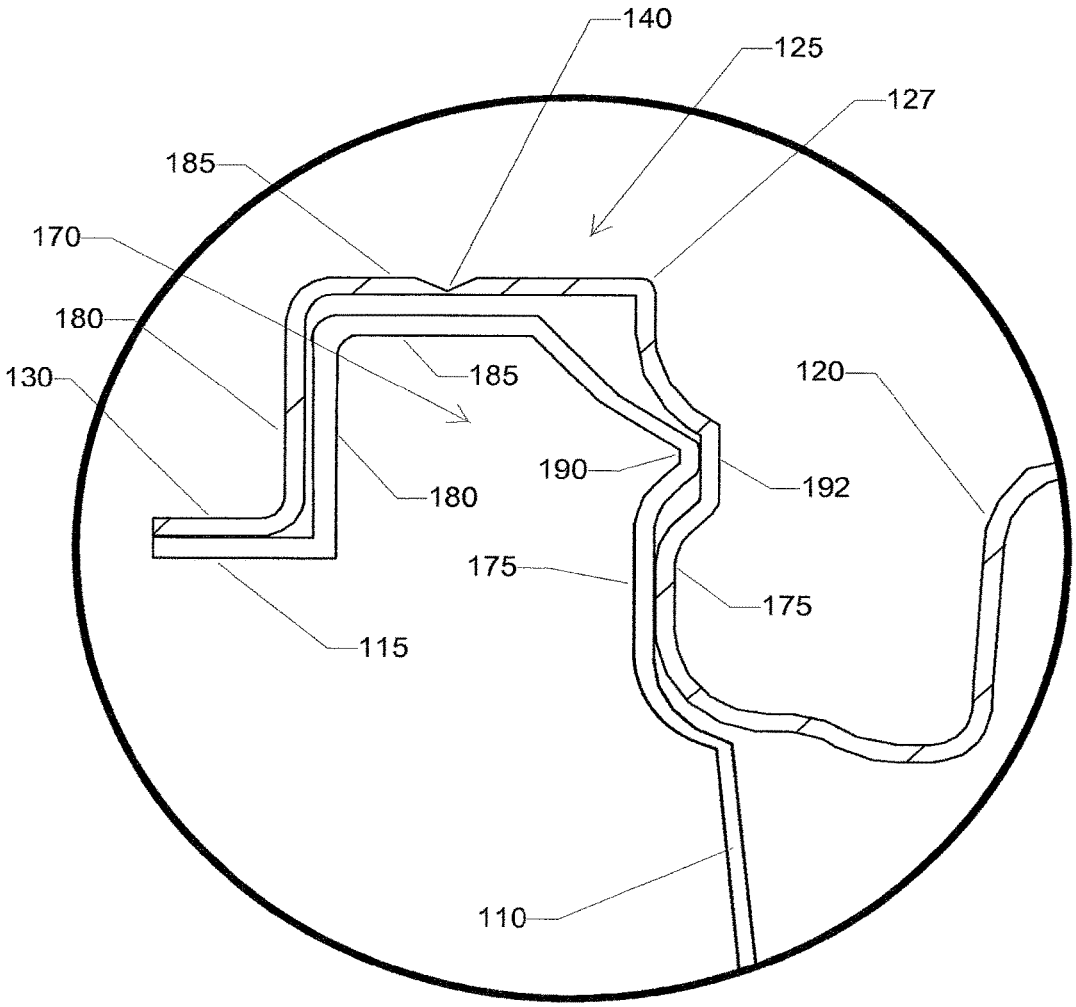
FIG. 6 shows an enlarged portion of the vertical cross-sectional view of FIG. 5, showing the peripheral edge of the lid interlocking with the peripheral edge of the tub.

FIG. 5 shows a vertical cross-sectional view of the tamper-evident container 100 of this embodiment taken through the middle of the container 100. FIG. 6 shows an enlarged portion of the vertical cross-sectional view of FIG. 5, showing the peripheral edge of the lid 120 interlocking with the peripheral edge of the tub 110. The tub edge 115 is disposed beneath the outer portion 130 of the lid edge 125 and extends peripherally outward so that the outer portion 130 of the lid edge 125 does not extend below the tub edge 115 in the vertical direction, i.e., the height direction of the container 100, when the container has an upright orientation.

However, as noted above, the removal tab 150, which extends from the lid edge 125, may extend downward below the tub edge 115 (see FIG. 2). For the purposes of description, the tab 150 can be considered to be a separate element extending from the lid edge 125, even though it is formed integrally with the lid edge 125. Nevertheless, even if the tab 150 is considered to be part of the lid edge 125, then it may be said that the tub edge 115 extends peripherally outward so that a substantial part of the outer portion 130 of the lid edge 125 does not extend below the tub edge 115. In other words, the tab 150 is the only portion of the lid 120 which extends below the tub edge 115.

As shown in FIG. 6, the tub edge 115 and the lid edge 125 each has a corresponding peripheral channel 170 configured so that one of the peripheral channels is received in the other of the peripheral channels for securing the lid 120 to the tub 110. Each of the peripheral channels 170 comprises an inner wall 175 and an outer wall 180 joined by a horizontal channel wall 185. The perforated section 140 of the lid edge 125 is formed in the horizontal channel wall 185 of the lid edge 125.

The inner wall 175 of the peripheral channel 170 of the tub edge 115 has a protrusion 190 which mates with a corresponding protrusion 192 in the inner wall 175 of the peripheral channel 170 of the lid edge 125 to create an interference fit, i.e., a "snap" fit, lock between the peripheral channels 170 to secure the lid 120 to the tub 110.

By virtue of this configuration, a first force applied to the outer portion 130 of the lid edge 125 which is sufficient to cause the perforated section 140 to separate is less than a second force which is sufficient to overcome an interference fit lock between the inner portion 127 of the lid edge 125 and the tub edge 115 to remove the lid 120 from the tub 110. Therefore, as discussed above, the tamper-evident strip 130 can be reliably removed from the lid 120 without opening the container 100. This, in turn, means that the container 100 cannot be opened without leaving visible evidence, i.e., without leaving a tamper-evident strip 130 which is at least partially detached from the lid 120.

In the embodiment of FIG. 6, the outer portion 130 of the lid edge 125 and the tub edge 115 extend outward about the same distance, i.e., their outermost edges are about even.

Figure 14:
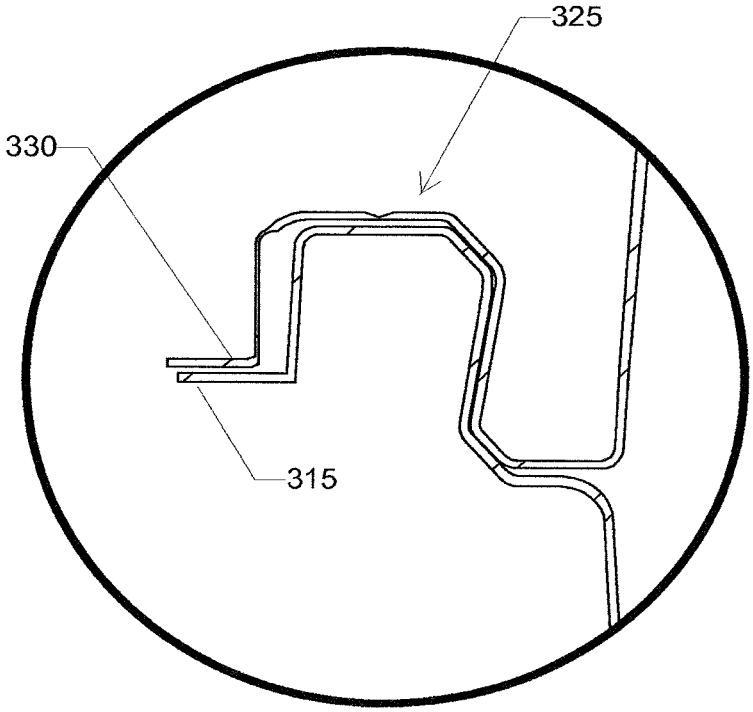

However, it may be the case that tub edge 115 extends further than the outer portion 130 of the lid edge 125 as in other embodiments described herein (see, e.g., FIG. 12) or vice versa (see, e.g., FIG. 14).

FIGS. 7-14 show an embodiment of a thermoformed, tamper-evident container 300 having a tub 310 and a hinged lid 320. Containers of this type may be used, for example, to store and display sandwiches or other food items. The tub 310 may be particularly shaped to closely match the shape of the food item to be stored therein, such as, for example, a sandwich that has been cut diagonally in half with the two halves packed together.

Figure 7:
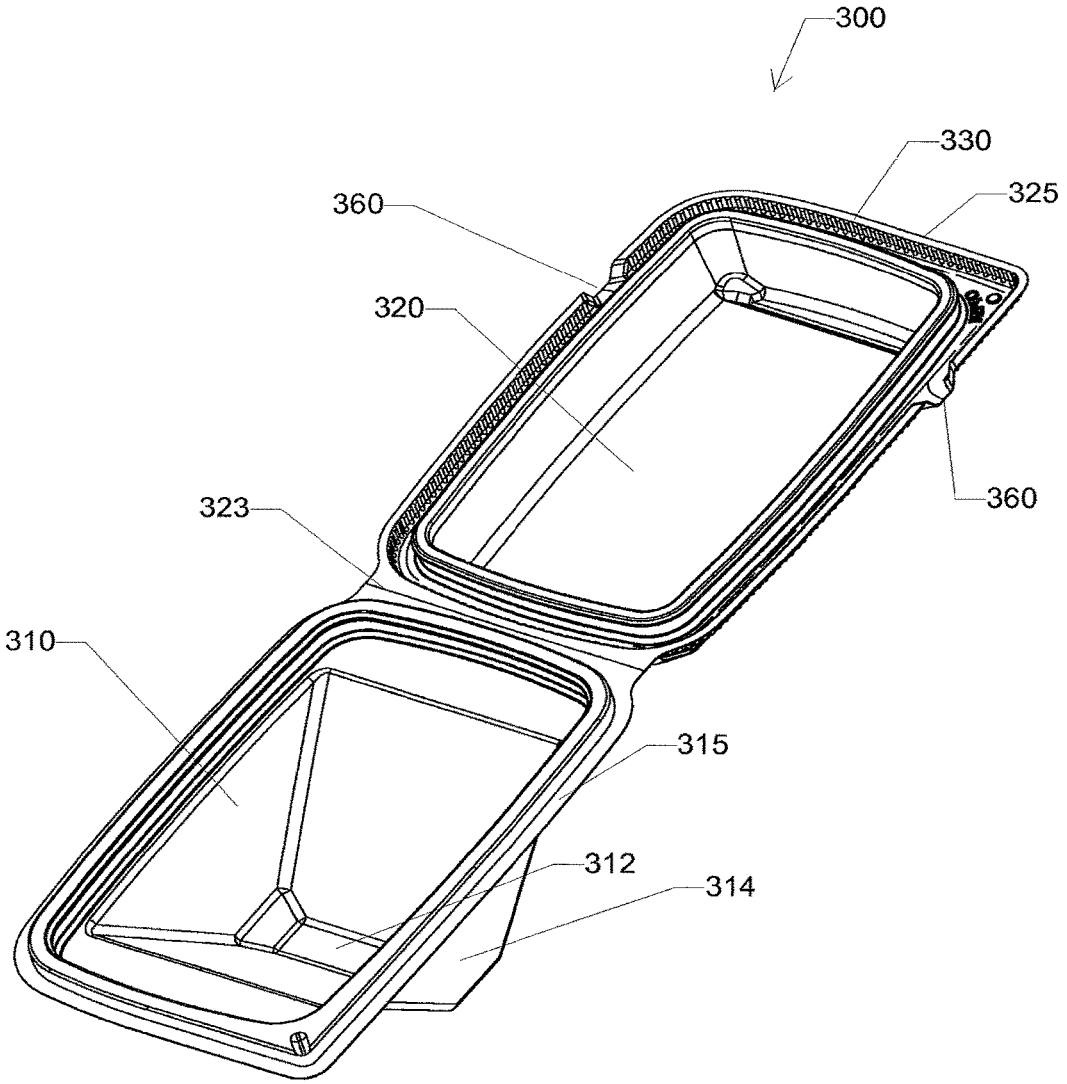
FIG. 7 shows an embodiment of a hinged tamper-evident container including a tub and a hinged lid, depicted prior to the lid being secured to the tub, the lid having a tear-away strip which is texturized and includes break points.

In FIG. 7, the container 300 is depicted prior to the lid 320 being secured to the tub 310 by folding the container 300 about the hinge 323. The tub 310 has a bottom 312 and a sidewall 314 forming an interior volume. For example, the tub 310 may have a wedge-like polyhedral shape with two trapezoidal opposing sidewalls 314 which narrow toward the bottom 312 of the tub 310. The lid 320 and the tub 310 are formed as a single unit so that the tub edge 315 and the outer portion 330 of the lid edge 325 are joined along a rear side of the container 300, with a hinge 323 being formed between the tub 310 and lid 320 to allow the lid 320 to be folded onto the tub 310 to close the container 300.

The tub 310 has an edge 315 extending peripherally outward from an upper edge of the sidewall 314. The lid 320 also has an edge 325 extending peripherally outward which is shaped to mate with the tub edge 315 to secure the container 300. The lid edge 325 has an inner portion 327 and an outer portion 330, the inner and outer portions having a perforated section 340 in between. The perforated section 340 extends continuously around the entire periphery of the lid 320. Alternatively, the perforated section 340 may extend around three sides of the lid 320 and only partly onto the fourth side of the lid 320 (as depicted in FIGS. 7-10).

The outer portion 330 of the lid edge 325 forms a tamper-evident seal, in the form of a tear-away strip, which is removable from the inner portion 327 for removing the lid 320 from the tub 310 and providing a tamper-evident indication. The outer portion 330 of the lid edge 325 optionally may include a tab (not shown) for ease of removal. In one advantageous aspect, before the outer portion 330 of the lid edge 325 is removed, the lid edge 325 can be coupled with with the tub edge 315 to secure the lid 320 to the tub 310 without applying heat or adhesive.

Figure 8:
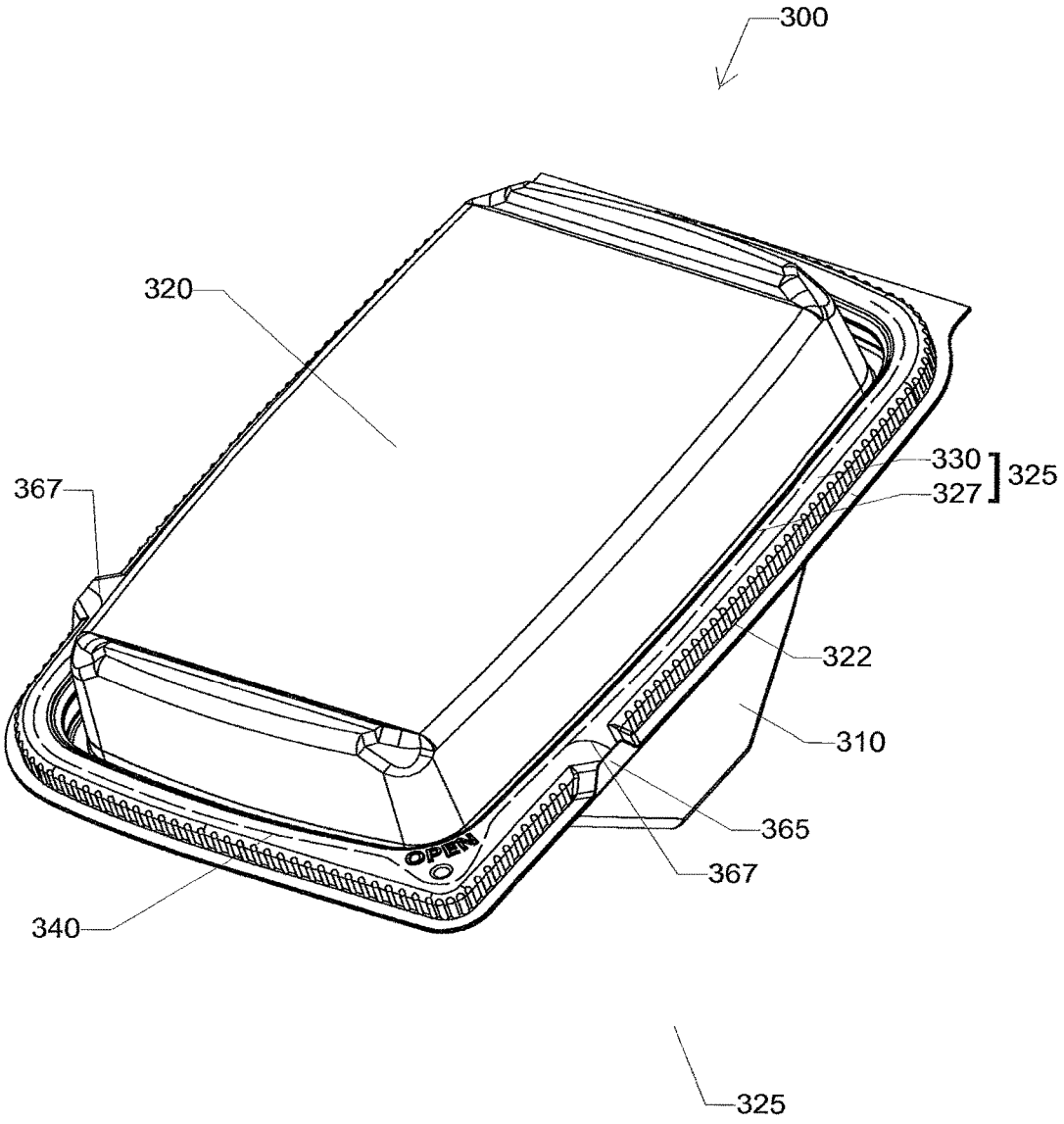
FIG. 8 shows the hinged tamper-evident container of FIG. 7 after the lid is secured to the tub by folding the lid about the hinge.
Figure 9:
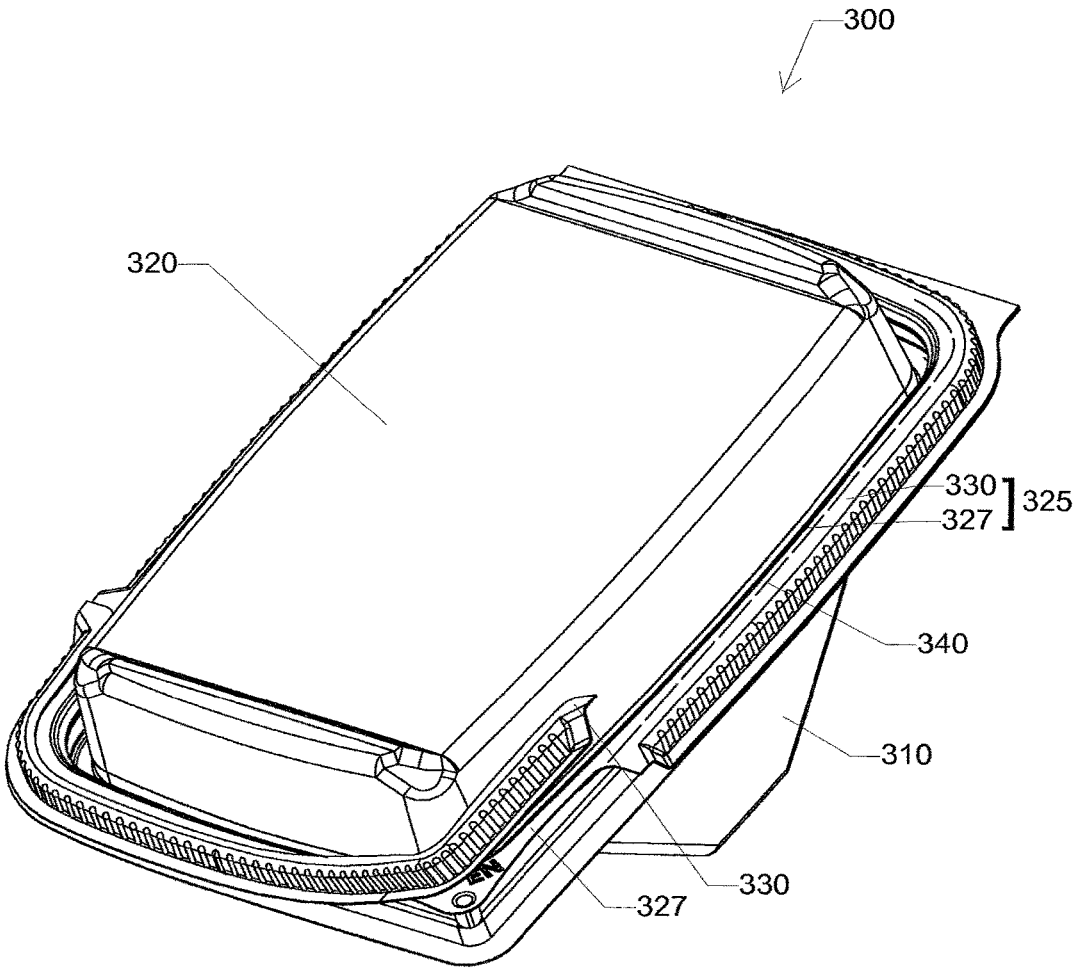
FIG. 9 shows the hinged tamper-evident container of FIG. 7 during the initial stage of removing the tear-away strip.

FIG. 8 shows the container 300 after the lid 320 is secured to the tub 310 by folding the lid 320 about the hinge 323 and before any of the tear-away strip (i.e., the outer portion 330 of the lid edge 325) has been removed. The end user, e.g., a consumer, removes the tear-away strip 330 by directly accessing the tear-away strip 330, e.g., at the corner or sides of the container 300, and pulling on the strip. FIG. 9 shows the hinged tamper-evident container 300 during the initial stage of removing the tear-away strip 330.

Figure 10:
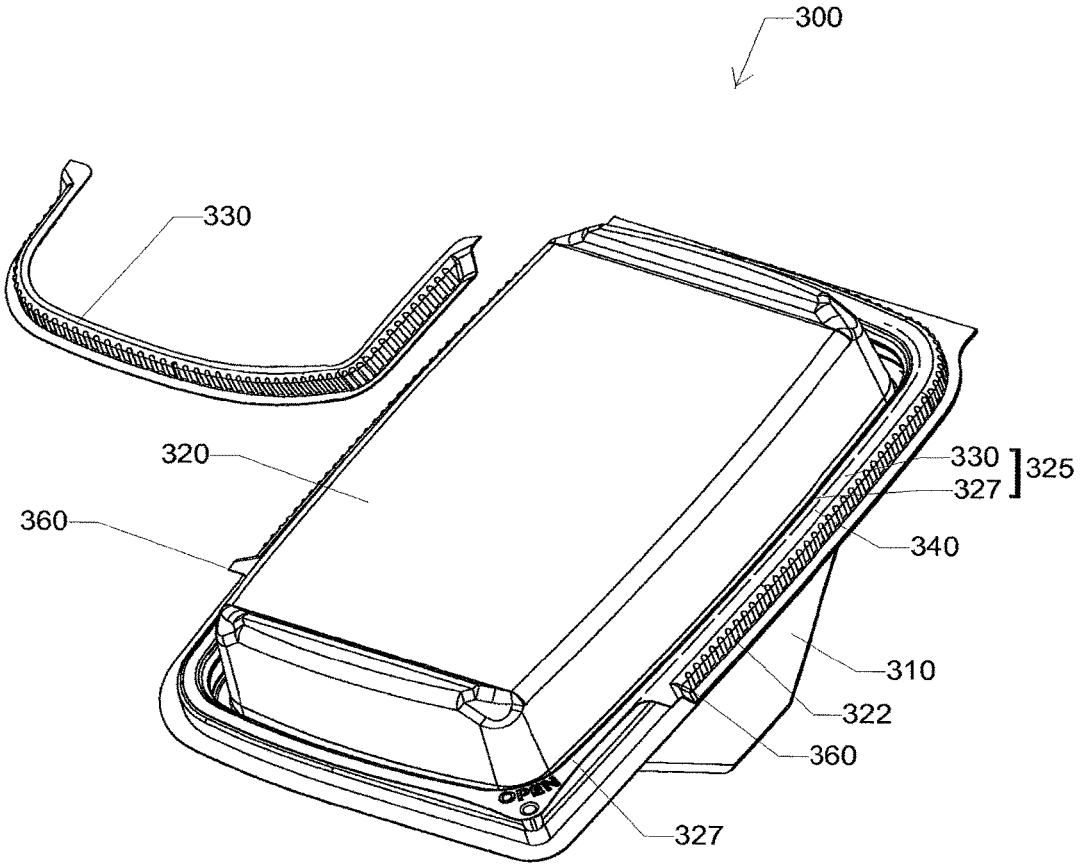
FIG. 10 shows the hinged tamper-evident container of FIG. 7 with a portion of the tear-away strip between two break points completely removed from the lid.

FIG. 10 shows the hinged tamper-evident container 300 with a portion of the tear-away strip 330 between two break points 360 completely removed from the lid 320. The break points 360, as discussed above, are formed by bridge portions. The bridge portions 360 are part of the outer portion 330 of the lid edge 325 and each is formed by a gap 365 (see FIG. 8) in the outer wall 380 of the peripheral channel 370 of the lid edge 325 (see FIG. 12 and related description below) and a perforated segment 367 (see FIG. 8) on the horizontal channel wall 385 of the peripheral channel 370. The perforated segment 367 extends outward from the perforated section 340 to divide the tamper-evident strip 330. In this embodiment, the outer portion 330 of the lid edge 325 includes at least two bridge portions 360 to enable the complete removal of the portion of the tamper-evident strip 330 between the bridge portions 360.

As shown, in FIGS. 7-10, texture elements 322 may be distributed around the tamper-evident seal (i.e., tear-away strip 330) which are shaped to provide a visual indication of the presence of the tamper-evident seal. The texture elements 322 may be, e.g., slots, ridges, bumps, indentations, protrusions, etc., which may be oriented in the vertical direction of the container 300 in the upright position. The texturized surface of the tear-away strip 330 makes it clear whether the strip is still in place or has been removed, because the rim portion left after the strip is removed clearly lacks the texture elements 322 (see FIG. 10).

Figure 11:
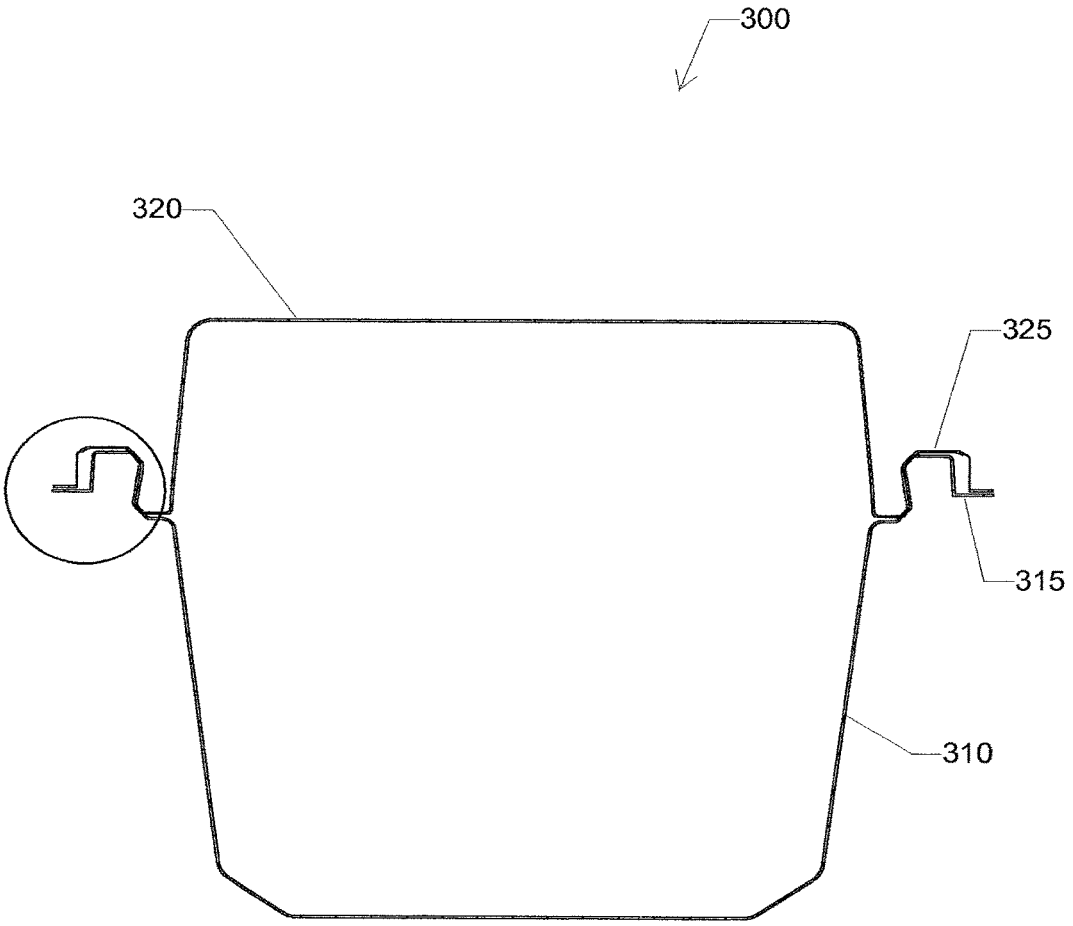
FIG. 11 shows a vertical cross-sectional view of the tamper-evident container of FIG. 7 taken through the middle of the tub.
Figure 12:
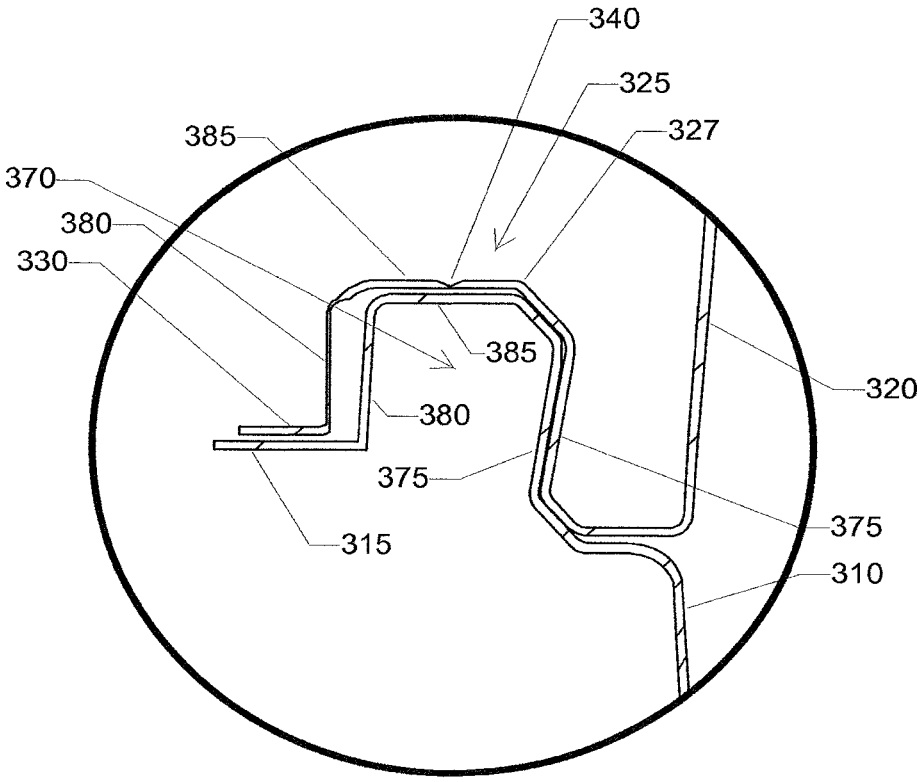
FIG. 12 shows an enlarged portion of the vertical cross-sectional view of FIG. 11, showing the peripheral edge of the lid interlocking with the peripheral edge of the tub.

FIG. 11 shows a vertical cross-sectional view of the hinged tamper-evident container 300 of this embodiment taken through the middle of the container 300. FIG. 12 shows an enlarged portion of the vertical cross-sectional view of FIG. 11, showing the peripheral edge of the lid 325 interlocking with the peripheral edge of the tub 315. The tub edge 315 is disposed beneath the outer portion 330 of the lid edge 325 and extends peripherally outward so that the outer portion 330 of the lid edge 325 does not extend below the tub edge 315 in the vertical direction, i.e., the height direction of the container 300, when the container 300 has an upright orientation.

As shown in FIG. 12, the tub edge 315 and the lid edge 325 each has a corresponding peripheral channel 370 configured so that one of the peripheral channels is received in the other of the peripheral channels for securing the lid 320 to the tub 310. Each of the peripheral channels 370 comprises an inner wall 375 and an outer wall 380 joined by a horizontal channel wall 385. The perforated section 340 of the lid edge 325 is formed in the horizontal channel wall 385 of the lid edge 325.

The inner wall 375 of the peripheral channel of the tub edge 315 and the inner wall 375 of the peripheral channel of the lid edge 325 each form an acute angle with respect to their corresponding horizontal channel walls 385 to create an interference fit lock between the peripheral channels 370 when the lid 320 is secured to the tub 310. By virtue of this configuration, a first force applied to the outer portion 330 of the lid edge 325 which is sufficient to cause the perforated section 340 to separate is less than a second force which is sufficient to overcome an interference fit lock between the inner portion 327 of the lid edge 325 and the tub edge 315 to remove the lid 320 from the tub 310.

Figure 13:
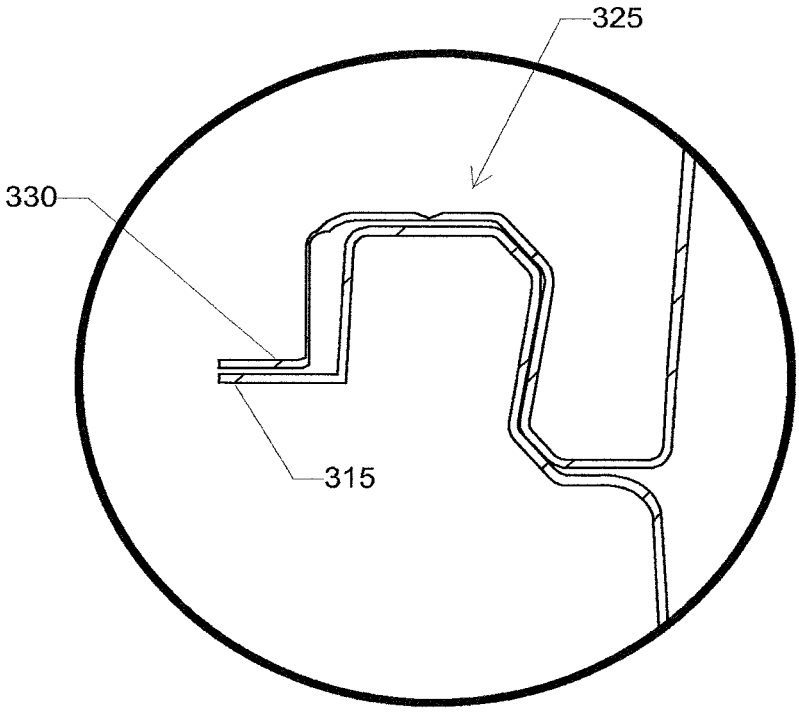
FIGS. 13-14 show alternative enlarged vertical cross-sectional views of a portion of the tamper-evident container of FIG. 7, showing the peripheral edge of the lid interlocking with the peripheral edge of the tub.

In the embodiment of FIG. 12, the tub edge 315 extends out further than the outer portion 330 of the lid edge 325. However, as shown in FIG. 13, it may be the case that the tub edge 315 and the outer portion 330 of the lid edge 325 extend outward about the same distance, i.e., their outermost edges may be about even. Alternatively, as shown in FIG. 14, it may be the case that outer portion 330 of the lid edge 325 extends further than the tub edge 315.

FIGS. 15-22 show an embodiment of a tamper-evident container 500 including a tray 510 and a lid 520. Containers of this type may be used, for example, to store and display large heated food items, such as a roasted chicken.

Figure 15:
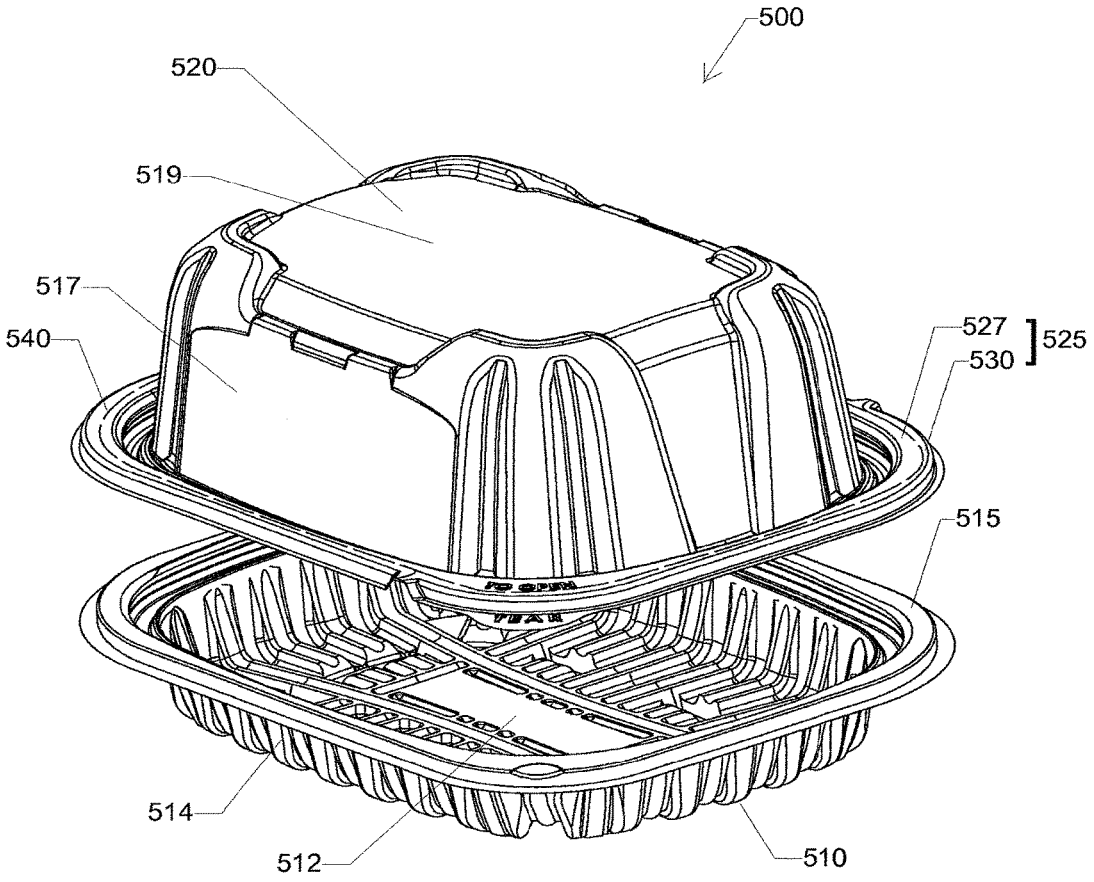
FIG. 15 shows an embodiment of a tamper-evident container including a tray and a lid, depicted prior to the lid being secured to the tray, the lid having a tear-away strip which includes a tab, break points and leak resistant properties.
Figure 16:
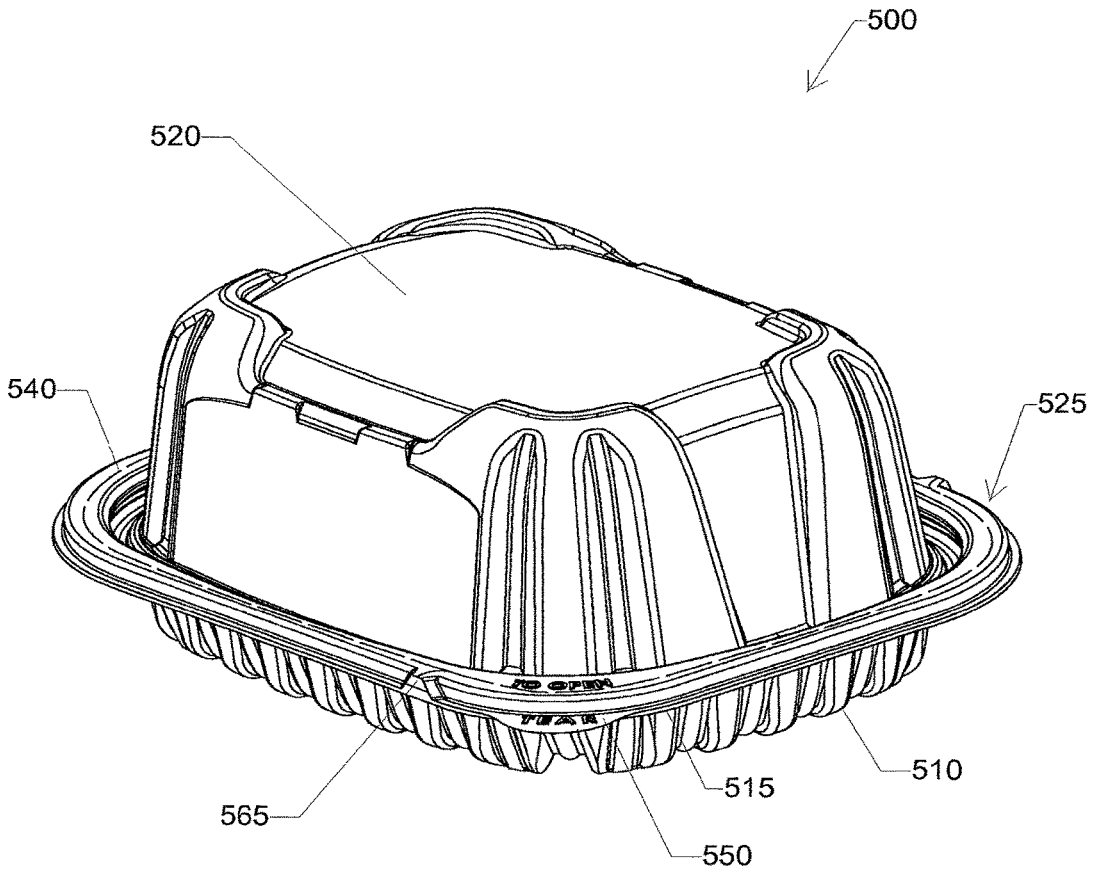
FIG. 16 shows the tamper-evident container of FIG. 15 after the lid is secured to the tray.

FIG. 15, in particular, depicts the container 500 of this embodiment prior to the lid 520 being secured to the tray 510. FIG. 16 shows the tamper-evident container 500 after the lid 520 is secured to the tray 510. In the embodiment depicted, the tray 510 is substantially rectangular in shape and has a flat bottom 512 (which may include a raised portion in the center to hold a food item) and a sidewall 514, e.g., a sidewall having four sides, which together define an interior volume of the container 500. The tray 510 has an upper edge, referred to herein as the "tray edge" 515, which extends peripherally outward from the upper edge of the sidewall 514, as will be described in further detail below.

In this embodiment, the lid 520 has a domed shape in which there are four walls 517 topped by a somewhat flat, but arched, surface 519 in the central portion thereof. Other shapes may also be used, such as, for example, a domed shape with a rounded top. Like the tray 510, the lid 520 has an edge 525 which extends peripherally outward from the mostly flat central portion. The lid edge 525 is shaped to mate with the tray edge 515 to secure the container 500.

The lid edge 525 has an inner portion 527 and an outer portion 530 having a perforated section 540 in between. The perforated section 540 extends continuously around the entire periphery of the lid 520. In this way, the outer portion 530 of the lid edge 525 forms a tamper-evident seal, in the form of a tear-away strip, which is removable from the inner portion 527 to allow the lid 520 to be removed from the tray 510.

In one advantageous aspect, before the outer portion 530 of the lid edge 525 is removed, the lid edge 525 is matable with the tray edge 515 to secure the lid 520 to the tray 510 without applying heat or adhesive. Thus, the container 500 can be loaded with a food item and secured simply by placing the lid 520 onto the tray 510 and snapping it into place. This avoids the use of special additional processes, such as heat shrink wrapping, etc., which reduces the time required to load and seal the container 500, thereby helping to ensure that these steps are done properly even in a busy retail setting.

FIG. 16 shows the tray 510 with a lid 520 in place before any of the tear-away strip (i.e., the outer portion 530 of the lid edge 525) has been removed. The end user, e.g., a consumer, accesses a removal tab 550 which extends from the lid 520 near a corner.

Figure 17:
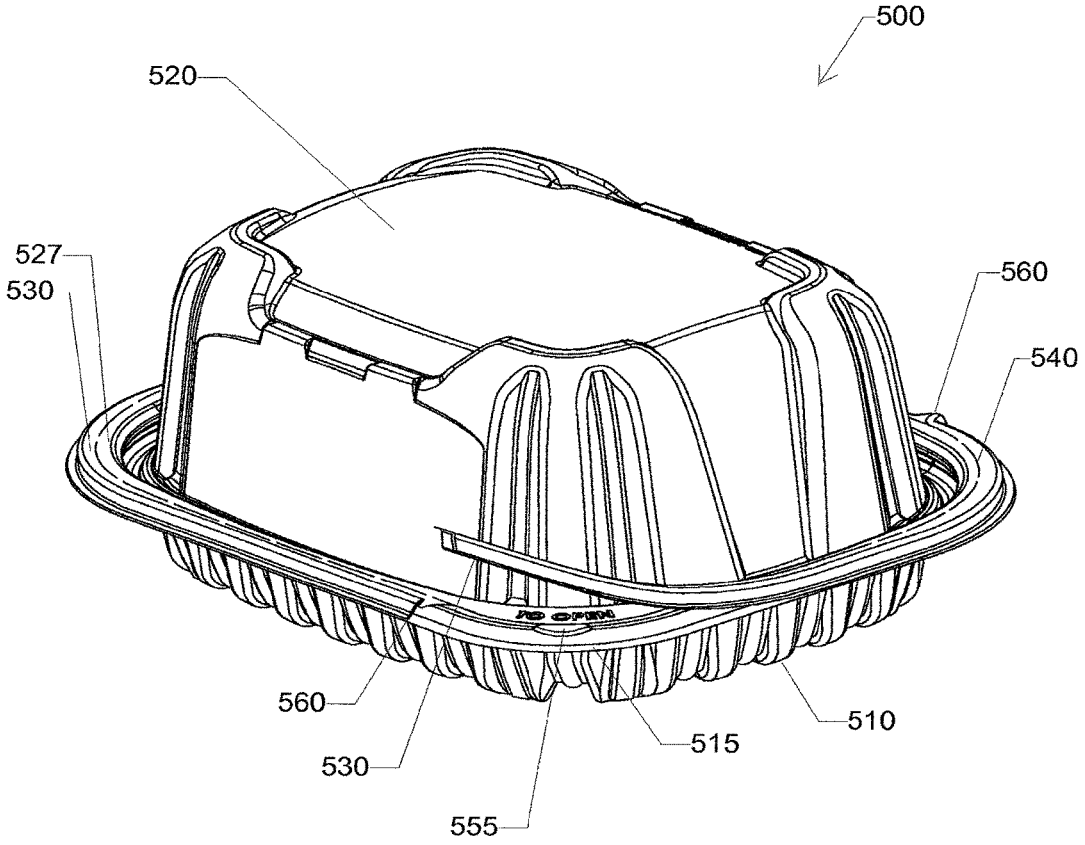
FIG. 17 shows the tamper-evident container of FIG. 15 during the initial stage of removing the tear-away strip by pulling on the tab.

FIG. 17 shows the tamper-evident container 500 of this embodiment during the initial stage of removing the tear-away strip 530 by pulling on the tab 550. The tab 550 extends from the outer portion 530 of the lid edge 525 and beyond the tray edge 515 (see FIG. 16). The force applied by the user on the tear-away strip 530 causes the outer portion 530 of the lid edge 525 to separate from the inner portion 527 of the lid edge 525 along the perforated section 540 without separating the lid 520 from the tray 510. Once the section of the tear-away strip 530 has been removed, the inner tab 555 portion of the lid 520 (i.e., "To Open" tab) may be accessed by the customer to allow an easy removal of the lid 520. Also, as explained in further detail below, the tear-away strip 530 itself breaks into separate pieces at defined break points or "bridge portions" 560.

Figure 18:
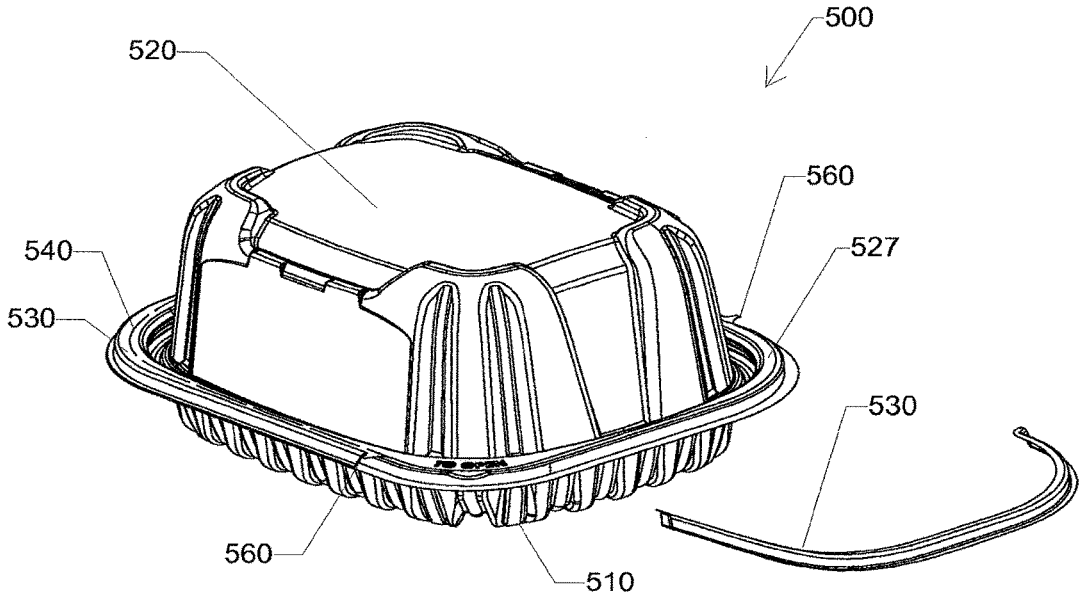
FIG. 18 shows the tamper-evident container of FIG. 15 with a portion of the tear-away strip between two break points completely removed from the lid.

FIG. 18 shows the tamper-evident container 500 of FIG. 15 with a portion of the tear-away strip 530 between two break points 560 completely removed from the lid 520. The break points 560, as discussed above, are formed by bridge portions. The bridge portions 560 are part of the outer portion 530 of the lid edge 525 and each is formed by a gap 565 (see FIGS. 16 and 20) in the outer wall 580 of the peripheral channel 570 of the lid 520 (see FIG. 22 and related description below) and a perforated segment 567 (see FIG. 19) on the horizontal channel wall 585 of the peripheral channel 570. The perforated segment 567 extends outward from the perforated section 540 to divide the tamper-evident strip. In this embodiment, the outer portion 530 of the lid edge 525 includes at least two bridge portions 560, so as to divide the tamper-evident strip 530 into at least two separate pieces. As in the embodiments discussed above, texture elements (not shown) may be distributed around the tamper-evident seal 530 which are shaped to provide a visual indication of the presence of seal.

Figure 19:
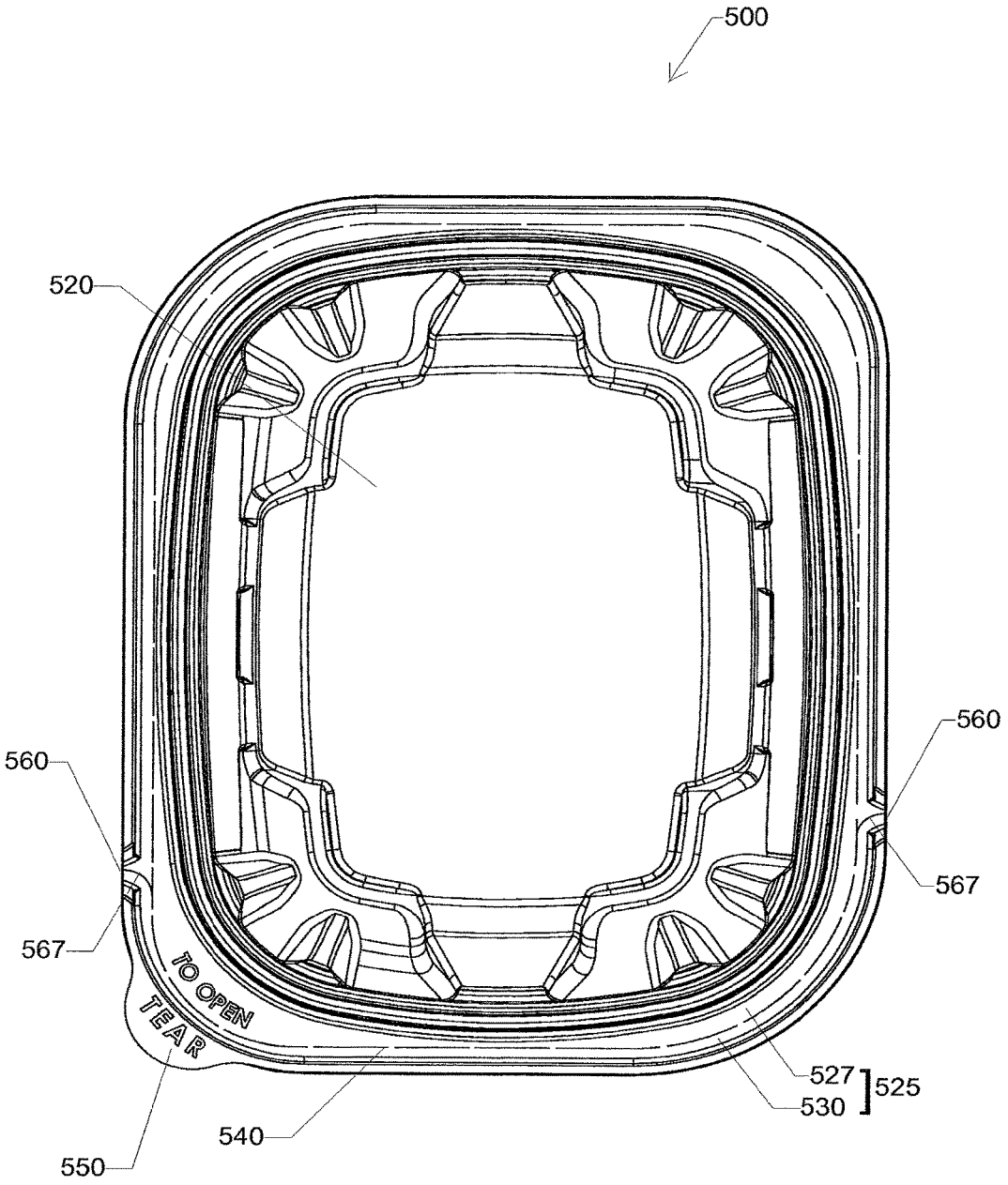
FIG. 19 shows a top view of the tamper-evident container of FIG. 15 and, in particular, showing the perforated section extending around the periphery of the lid between the inner and outer portions of the lid edge and a perforated segments at the bridges separating the tear-away strip into separate pieces.
Figure 20:
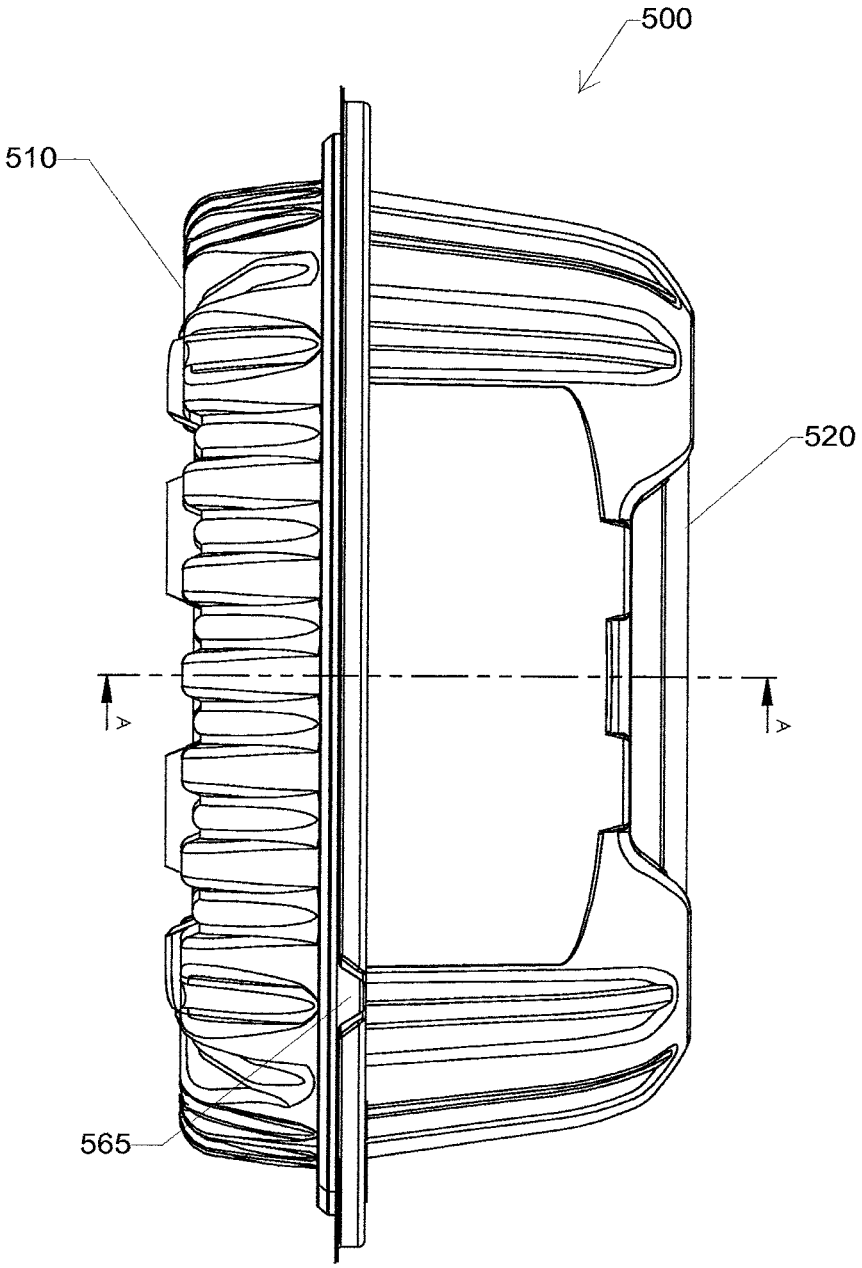
FIG. 20 shows a side view of the tamper-evident container of FIG. 15.

FIG. 19 shows a top view of the tamper-evident container 500 of this embodiment and, in particular, showing the perforated section 540 extending around the periphery of the lid 520 between the inner portion 527 and outer portion 530 of the lid edge 525 and the perforated segments 567 at the bridge portions 560 separating the tear-away strip 530 into separate pieces. FIG. 20 shows a side view of the tamper-evident container 500.

Figure 21:
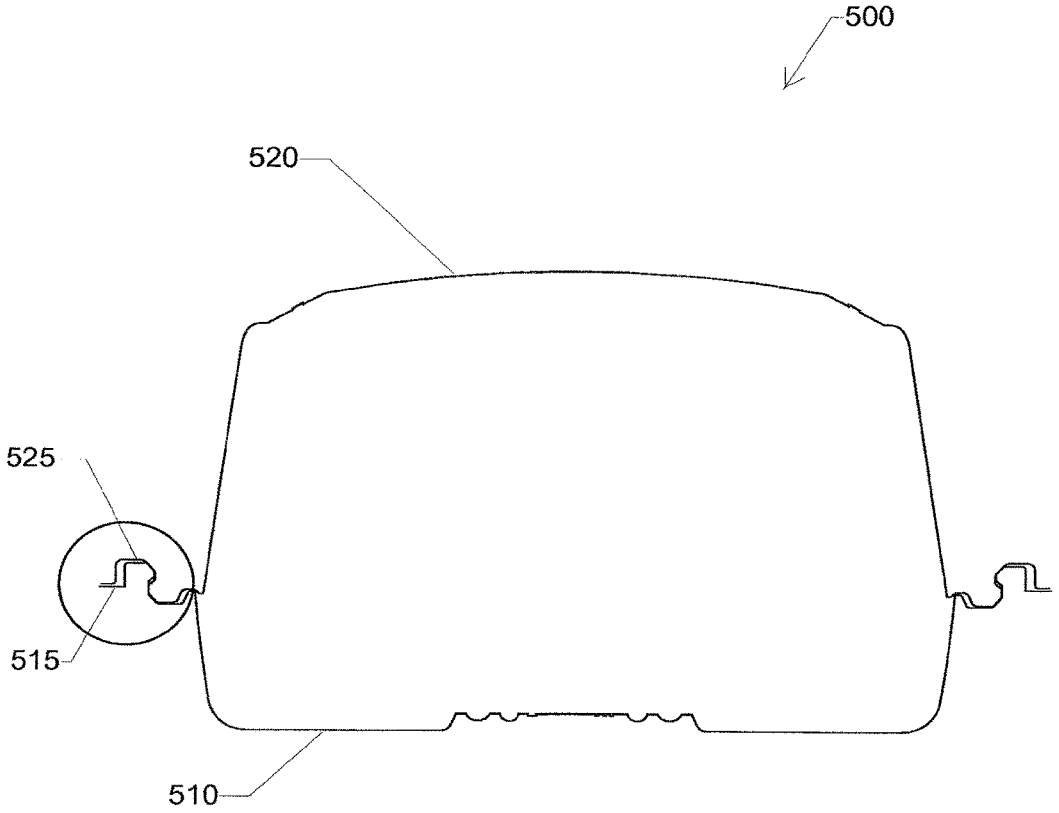
FIG. 21 shows a vertical cross-sectional view of the tamper-evident container of FIG. 15 taken through line A-A in FIG. 20.
Figure 22:
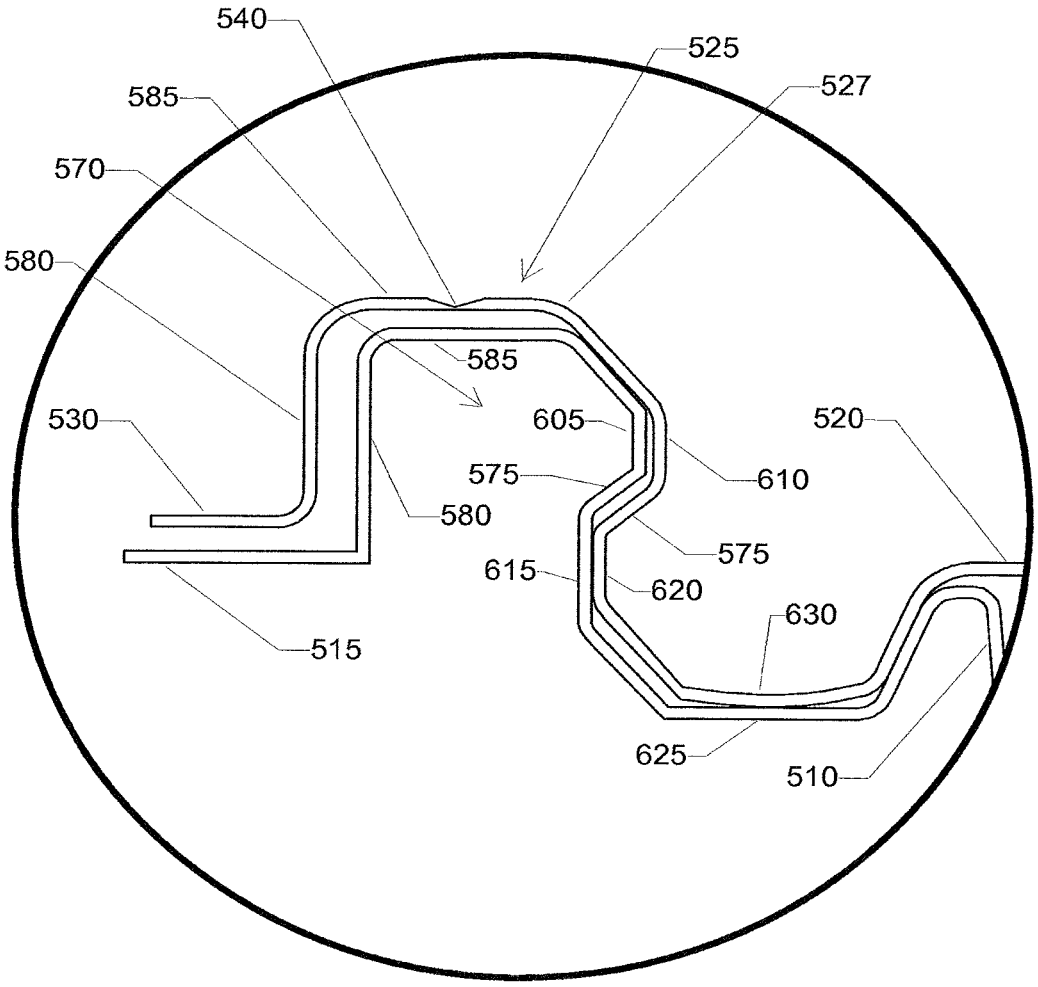
FIG. 22 shows an enlarged portion of the vertical cross-sectional of FIG. 21, showing the peripheral edge of the lid interlocking with the peripheral edge of the tray.

FIG. 21 shows a vertical cross-sectional view of the tamper-evident container 500 of this embodiment taken through line A-A in FIG. 20. FIG. 22 shows an enlarged portion of the vertical cross-sectional of FIG. 21, showing the peripheral edge of the lid interlocking with the peripheral edge of the tray. The tray edge 515 is disposed beneath the outer portion 530 of the lid edge 525 and extends peripherally outward so that the outer portion 530 of the lid edge 525 does not extend below the tray edge 515 in the vertical direction, i.e., the height direction of the container 500, when the container has an upright orientation.

As shown in FIG. 22, the tray edge 515 and the lid edge 525 each has a corresponding peripheral channel 570 configured so that one of the peripheral channels is received in the other of the peripheral channels for securing the lid 520 to the tray 510. Each of the peripheral channels 570 comprises an inner wall 575 and an outer wall 580 joined by a horizontal channel wall 585. The perforated section 540 of the lid edge 525, discussed above, is formed in the horizontal channel wall 585 of the lid edge 525.

As further shown in FIG. 22, the inner wall 575 of the peripheral channel 570 of the tray edge 515 has a first protrusion 605 which mates with a corresponding first protrusion 610 in the inner wall 575 of the peripheral channel 570 of the lid edge 525 to create an interference fit between the peripheral channels 570 when the lid 520 is secured to the tray 510. The inner wall 575 of the peripheral channel 570 of the tray edge 515 also has a second protrusion 615 which mates with a corresponding second protrusion 620 in the inner wall 575 of the peripheral channel 570 of the lid edge 525 to create an interference fit between the peripheral channels when the lid 520 is secured to the tray 510, the first protrusions (605 and 610) and the second protrusions (615 and 620) may be oriented to face in opposite directions, i.e., in an inner and outer facing direction with respect to the container 500. Thus, the inner walls 575 provide a locking function for the container 500.

There is also a third, downward facing protrusion 625 formed in the tray edge 515 between the inner wall 575 of the peripheral channel 570 of the tray edge 515 and the point at which the tray edge 515 meets the sidewall of the tray 510. This third protrusion 625 is shaped to mate with a corresponding third protrusion 630 formed in the lid edge 525 between the inner wall 575 of the peripheral channel 570 of the lid edge 525 and the point at which the lid edge 525 meets the sidewall of the lid 520. The interference fit lock formed between the first, second, and third protrusions of the tray edge 515 and the corresponding first, second, and third protrusions of the lid edge 525 provides strong resistance to liquid escaping from the container 500 between the tray edge 515 and lid edge 525.

By virtue of this configuration, a first force applied to the outer portion 530 of the lid edge 525 which is sufficient to cause the perforated section 540 to separate is less than a second force which is sufficient to overcome an interference fit lock between the inner portion 527 of the lid edge 525 and the tray edge 515 to remove the lid 520 from the tray 510.

This configuration of locking protrusions also serves to provide leak-resistant properties to the container 500, which is particularly important as the container is designed to store food items, such as roasted chickens, which may involve a large quantity of oily liquid.

The inner wall 575 of the peripheral channel 570 of the tray edge 515 includes sealing surfaces which press against corresponding sealing surfaces of the inner wall 575 of the peripheral channel 570 of the lid edge 525. A first set of corresponding sealing surfaces is provided by the second protrusions (615 and 620), a second set of sealing surfaces is provided by the third protrusions (625 and 630), and a third set of sealing surfaces is provided on the diagonally-sloping portion between the third protrusions (625 and 630) and the point at which the lid 520 and tray 510 separate at the interior of the container 500 (see far right-hand portion of FIG. 22). These three sets of sealing surfaces form a three-stage leak-resistant seal between the lid edge 530 and the tray edge 525.

In the embodiment of FIG. 22, the tray edge 515 extends out further than the outer portion 530 of the lid edge 525. However, that it may be the case that the tray edge 515 and the outer portion 530 of the lid edge 525 extend outward about the same distance, i.e., their outermost edges may be about even, as in other embodiments described herein (see, e.g., 13). Alternatively, the outer portion 530 of the lid edge 525 may extend further than the tray edge 515 (see, e.g., FIG. 14).

Although example embodiments have been shown and described in this specification and figures, it would be appreciated by those skilled in the art that changes may be made to the illustrated and/or described example embodiments without departing from their principles and spirit.

What is claimed is:

1. A tamper-evident container formed by thermoforming, comprising:

a tub having a bottom and a sidewall forming an interior volume, the tub further comprising an edge extending peripherally outward from an upper edge of the sidewall;

a lid having an edge extending peripherally outward therefrom, the lid edge being configured to mate with the tub edge to close the container, the lid edge having an inner portion and an outer portion, the inner and outer portions having a perforated section therebetween, the perforated section extending continuously around the entire periphery of the lid, whereby the outer portion forms a tamper-evident seal removable from the inner portion for removing the lid from the tub; and a plurality of texture elements distributed around the outer portion of the lid edge, the texture elements being configured to provide a visual indication of the presence of the tamper-evident seal, wherein the tub edge is disposed beneath the outer portion of the lid edge and extends peripherally outward so that a substantial part of the outer portion of the lid edge does not extend below the tub edge in a vertical direction of the container in an upright orientation, and wherein a tab extends from the outer portion of the lid edge and beyond the tub edge, the tab extending below the tub edge in the vertical direction of the container.

2. The tamper-evident container of claim 1, wherein a first force applied to the outer portion of the lid edge sufficient to cause the perforated section to separate is less than a second force sufficient to overcome an interference fit lock between the inner portion of the lid edge and the tub edge to remove the lid from the tub.

3. The tamper-evident container of claim 1, wherein after the outer portion of the lid edge is removed, the inner portion of the lid edge is configured for an interference fit with the tub edge for removably securing the lid to the tub.

4. The tamper-evident container of claim 1, wherein the inner portion of the lid edge comprises an inner tab having an edge that is exposed when the tamper-evident seal is removed.

5. The tamper-evident container of claim 1, wherein the texture elements comprise ridges extending in the vertical direction of the container.

6. The tamper-evident container of claim 1, wherein the container is formed of any of the following plastic materials: high density polyethylene (HDPE), polyethylene terephthalate (PET), polypropylene (PP), polystyrene (PS), and polylactic acid (PLA).

7. The tamper-evident container of claim 1, wherein the outer portion of the lid edge, except for the tab, is in contact with the tub edge around the entire periphery of the tub.

8. The tamper-evident container of claim 1, wherein the tab is the only portion of the lid extending below the tub edge.

9. The tamper-evident container of claim 1, wherein the tub edge and the lid edge each has a corresponding peripheral channel configured so that one of the peripheral channels is received in the other of the peripheral channels for securing the lid to the tub.

10. The tamper-evident container of claim 9, wherein each of the peripheral channels comprises an inner wall and an outer wall joined by a horizontal channel wall.

11. The tamper-evident container of claim 10, wherein the inner wall of the peripheral channel of the tub edge has a protrusion which mates with a corresponding protrusion in the inner wall of the peripheral channel of the lid edge to create an interference fit between the peripheral channels when the lid is secured to the tub.

12. The tamper-evident container of claim 10, wherein the perforated section of the lid edge is formed in the horizontal channel wall of the lid edge.

13. The tamper-evident container of claim 12, wherein the outer portion of the lid edge comprises a bridge portion formed by a gap in the outer wall of the peripheral channel and having a perforated segment on the horizontal channel wall of the peripheral channel, the perforated segment extending outward from the perforated section to divide the tamper-evident strip.

14. The tamper-evident container of claim 13, wherein the outer portion of the lid edge comprises at least two bridge portions so as to divide the tamper-evident strip into at least two separate pieces.

15. A tamper-evident container formed by thermoforming, the container comprising, a tub having a bottom and a sidewall forming an interior volume, the tub further comprising an edge extending peripherally outward from an upper edge of the sidewall;

a lid having an edge extending peripherally outward therefrom, the lid edge being configured to mate with the tub edge to close the container, the lid edge having an inner portion and an outer portion, the inner and outer portions having a perforated section therebetween, the perforated section extending continuously in one or more segments around substantially the entire periphery of the lid, whereby the outer portion forms a tamper-evident seal removable from the inner portion for removing the lid from the tub; and a plurality of texture elements distributed around the outer portion of the lid edge, the texture elements being configured to provide a visual indication of the presence of the tamper-evident seal, wherein before the outer portion of the lid edge is removed, the lid edge is configured to mate with the tub edge to secure the lid to the tub without applying heat or adhesive.

16. The tamper-evident container of claim 15, wherein a first force applied to the outer portion of the lid edge sufficient to cause the perforated section to separate is less than a second force sufficient to overcome an interference fit lock between the inner portion of the lid edge and the tub edge to remove the lid from the tub.

17. The tamper-evident container of claim 15, wherein after the outer portion of the lid edge is removed, the inner portion of the lid edge is configured for an interference fit with the tub edge for removably securing the lid to the tub.

18. The tamper-evident container of claim 15, wherein a tab extends from the outer portion of the lid edge and beyond the tub edge, the tab extending below the tub edge in a vertical direction of the container in an upright orientation.

19. The tamper-evident container of claim 18, wherein the tab is the only portion of the lid extending below the tub edge.

20. The tamper-evident container of claim 15, wherein the tub edge and the lid edge each has a corresponding peripheral channel configured so that one of the peripheral channels is received in the other of the peripheral channels for securing the lid to the tub.

21. The tamper-evident container of claim 20, wherein each of the peripheral channels comprises an inner wall and an outer wall joined by a horizontal channel wall.

22. The tamper-evident container of claim 21, wherein the inner wall of the peripheral channel of the tub edge has a protrusion which mates with a corresponding protrusion in the inner wall of the peripheral channel of the lid edge to create an interference fit between the peripheral channels when the lid is secured to the tub.

23. The tamper-evident container of claim 21, wherein the perforated section of the lid edge is formed in the horizontal channel wall of the lid edge.

24. The tamper-evident container of claim 23, wherein the outer portion of the lid edge comprises a bridge portion formed by a gap in the outer wall of the peripheral channel and having a perforated segment on the horizontal channel wall of the peripheral channel, the perforated segment extending outward from the perforated section to divide the tamper-evident strip.

25. The tamper-evident container of claim 24, wherein the outer portion of the lid edge comprises at least two bridge portions so as to divide the tamper-evident strip into at least two separate pieces.

26. The tamper-evident container of claim 25, wherein the lid and the tub are formed as a single unit so that the tray edge and the outer portion of the lid edge are joined along a side of the container, with a hinge being formed between the tray and lid to allow the lid to be folded onto the tray to close the container.

27. The tamper-evident container of claim 26, wherein the tub has a wedge-like polyhedral shape with two trapezoidal opposing sides which narrow toward the bottom of the tub.

* * * * *